United States Patent [19]

Koshimizu et al.

[11] Patent Number: 4,774,167

[45] Date of Patent: Sep. 27, 1988

[54] METHOD FOR PROCESSING SILVER HALIDE COLOR PHOTOGRAPHIC MATERIALS WHEREIN THE COLOR DEVELOPER CONTAINS LOW CONCENTRATIONS OF BENZYL ALCOHOL, HYDROXYLAMINE AND SULFITE

[75] Inventors: Toshio Koshimizu; Takatoshi Ishikawa; Shinji Ueda, all of Kanagawa, Japan

[73] Assignee: Fuji Photo Film Co., Ltd., Kanagawa, Japan

[21] Appl. No.: 17,407

[22] Filed: Feb. 24, 1987

[30] Foreign Application Priority Data

Feb. 24, 1986 [JP] Japan ..... 61-39761
May 19, 1986 [JP] Japan ..... 61-114274

[51] Int. Cl.[4] ..... G03C 7/30; G03C 7/16

[52] U.S. Cl. ..... 430/380; 430/377; 430/464; 430/467; 430/484; 430/485; 430/478

[58] Field of Search ..... 430/372, 377, 380, 464, 430/467, 484, 485, 478

[56] References Cited

U.S. PATENT DOCUMENTS

| | | | |
|---|---|---|---|
| 3,996,054 | 12/1976 | Santemma et al. | 430/467 |
| 4,035,188 | 7/1977 | Yabata et al. | 430/467 |
| 4,113,491 | 9/1978 | Deguchi et al. | 430/467 |
| 4,299,914 | 11/1981 | Fujumatsu et al. | 430/552 |
| 4,304,844 | 12/1981 | Fujumatsu et al. | 430/552 |
| 4,396,698 | 8/1983 | Karino et al. | 430/372 |
| 4,443,536 | 4/1984 | Lestina | 430/552 |
| 4,481,268 | 11/1984 | Bailey et al. | 430/372 |
| 4,524,132 | 6/1985 | Aoki et al. | 430/552 |
| 4,526,861 | 7/1985 | Ichijima et al. | 430/385 |
| 4,529,690 | 7/1985 | Ohbayashi et al. | 430/551 |
| 4,564,590 | 1/1986 | Sasaki et al. | 430/552 |
| 4,565,777 | 1/1986 | Ogawa et al. | 430/552 |
| 4,618,573 | 10/1986 | Okamura et al. | 430/558 |

FOREIGN PATENT DOCUMENTS

| | | | |
|---|---|---|---|
| 211437 | 2/1987 | European Pat. Off. . | |
| 29461 | 8/1974 | Japan . | |
| 52058 | 4/1980 | Japan . | |
| 200037 | 12/1982 | Japan . | |
| 31334 | 2/1983 | Japan . | |
| 50536 | 3/1983 | Japan . | |
| 42045 | 3/1983 | Japan . | |
| 48755 | 3/1984 | Japan . | |
| 174836 | 10/1984 | Japan . | |
| 177553 | 10/1984 | Japan . | |
| 177554 | 10/1984 | Japan . | |
| 177555 | 10/1984 | Japan . | |
| 177556 | 10/1984 | Japan . | |
| 177557 | 10/1984 | Japan . | |
| 178459 | 10/1984 | Japan . | |
| 19140 | 1/1985 | Japan . | |
| 26338 | 2/1985 | Japan . | |
| 26339 | 2/1985 | Japan . | |
| 162256 | 8/1985 | Japan . | |
| 158444 | 8/1985 | Japan . | |
| 158446 | 9/1985 | Japan | 430/464 |
| 172042 | 9/1985 | Japan . | |
| 70552 | 4/1986 | Japan . | |
| 30250 | 2/1987 | Japan . | |

*Primary Examiner*—Paul R. Michl
*Assistant Examiner*—Patrick A. Doody
*Attorney, Agent, or Firm*—Sughrue, Mion, Zinn, Macpeak, and Seas

[57] ABSTRACT

A method for processing a silver halide color photographic material is provided, which comprises subjecting an imagewise exposed silver halide color photographic material having at least one silver halide emulsion layer on a reflective support to color development for a period not exceeding 2 minutes and 30 seconds using a color-developing solution containing substantially no benzyl alcohol, a sulfite in a concentration of $8\times10^{-3}$ mol/liter or less, and a hydroxylamine in a concentration of $1.5\times10^{-2}$ mol/liter or less, thereby achieving high color densities of the developed images and reduced fog. The effects of this method are particularly significant in photographic paper containing a pyrazoloazole type magenta coupler.

20 Claims, No Drawings

METHOD FOR PROCESSING SILVER HALIDE COLOR PHOTOGRAPHIC MATERIALS WHEREIN THE COLOR DEVELOPER CONTAINS LOW CONCENTRATIONS OF BENZYL ALCOHOL, HYDROXYLAMINE AND SULFITE

FIELD OF THE INVENTION

The present invention relates to a process for processing silver halide color photographic materials and, more particularly, the invention relates to a processing process for color photographic materials including a very shortened color development time without using benzyl alcohol.

BACKGROUND OF THE INVENTION

Hitherto, various kinds of developing agent penetrants have been investigated for increasing the coloring property of color photographic light-sensitive materials and, in particular, a process of quickening color development by adding benzyl alcohol to a color developing solution has been widely used at present for the processing of color photographic materials because of accelerating a coloring effect, particularly color photographic papers.

However, a color developing solution containing benzyl alcohol tends to cause stains. In general, to inhibit the generation of stains, it is effective to use preservatives such as a hydroxylamine salt and a sulfite in concentrations of from $1.2\times10^{-2}$ to $8\times10^{-2}$ mol/liter and from 0.02 to 0.04 mol/liter, respectively. Since developing solutions containing such preservatives in concentrations lower than the above-described values have resulted in significant generation of stains, decreases in the required addition amounts of those preservatives have so far failed to be achieved.

In adding benzyl alcohol to a color-developing solution, diethylene glycol, triethylene glycol, an alkanolamine, or the like is required as a solvent, because benzyl alcohol has poor solubility in water.

Since, however, the above-described compounds including benzyl alcohol have high BOD (biochemical oxygen demand) and COD (chemical oxygen demand) pollution loading values, it is preferred to avoid use of benzyl alcohol as much as possible.

Furthermore, even in the case of using the aforesaid solvent, it requires a long time to dissolve benzyl alcohol, and hence it is also better to avoid use of benzyl alcohol for the purpose of reducing the work load involved in preparing the solution of benzyl alcohol.

Also, when benzyl alcohol existing in a color developing solution is carried in a bleach bath or a blix (bleach-fix) bath which is a post-bath of the color developing solution, it causes the formation of the leuco dye of a cyan dye, which further causes the reduction of coloring density. Still further, when such benzyl alcohol exists in a bleaching solution or a blix solution, it delays the washing out speed of developing solution components from color photographic materials, and hence it sometimes results in adverse influences on the stability or storability of color images of processed color photographic materials. Accordingly, it is also preferred to avoid use of benzyl alcohol for these reasons also.

Color development is generally performed for about 3 to 4 minutes, but recently with the shortening of the time for delivering finished photographic products and the reduction of laboratory work, it has been desired to shorten the processing time for photographic materials.

On the other hand, when the development time for color photographic materials is shortened without using benzyl alcohol, which is a coloring accelerator, the coloring density is inevitably greatly reduced.

For solving the above-described problems, various color development accelerators have been described, for example, in U.S. Pat. Nos. 2,950,970, 2,515,147, 2,496,903, 2,304,925, 4,038,075, 4,119,462, British Pat. No. 1,455,413, Japanese patent application (OPI) Nos. 15831/78, 62450/80, 62451/80, 62452/80, 62453/80, 50536/83 and 162256/85 (the term "OPI" as used herein refers to a "published unexamined Japanese patent application"), Japanese patent publication Nos. 12422/76, 49728/80, etc. However, even by the use of these color development accelerators, a satisfactory coloring density has not yet been obtained.

Also, methods for incorporating color developing agents in color photographic materials are proposed as described, for example, in U.S. Pat. Nos. 3,719,492, 3,342,559, 3,342,597, Japanese patent application (OPI) Nos. 6235/81, 16133/81, 97531/82, 83565/82, etc., but these methods have disadvantages in that the color development is delayed and the formation of fog is increased, and thus are not proper methods.

Furthermore, a method of using a silver chloride emulsion as described, for example, in Japanese patent application (OPI) Nos. 95345/83, 232342/84, 19140/85, etc., may shorten the color development time but is likely to be difficult to attain a high sensitivity. In addition, color forming property is impaired to a great extent in the presence of sulfurous acid ion.

Thus, a method for forming color images having sufficiently excellent color forming property and reduced stain using a color developing solution substantially free from benzyl alcohol in a short time would be highly desirable.

Methods of accelerating color development by incorporation of 1-phenyl-3-pyrazolidone derivatives in silver halide color photographic materials are described in Japanese patent application (OPI) Nos. 144547/82, 146236/85, 50532/83, 115438/83, 158444/85, 158445/85, and 165651/85, etc. In addition, methods for reducing a benzyl alcohol concentration are described in Japanese patent application (OPI) Nos. 50536/83 and 158446/85.

However, none of these patents describe improvements brought about in photographic properties under the condition that a color developing solution contains substantially no benzyl alcohol, and furthermore, a color developing time reduced to less than 2 minutes and 30 seconds.

SUMMARY OF THE INVENTION

Therefore, an object of the present invention is to provide a processing method which ensures sufficiently excellent color forming property and reduced stain even when a color-developing solution containing substantially no benzyl alcohol is employed, and, furthermore, even when color development is carried out for a short period of less than 2 minutes and 30 seconds.

The above-described object is effectively attained by a method which comprises subjecting a silver halide color photographic material, which has at least one silver halide emulsion layer on a reflective support to color development for a period not exceeding 2 minutes and 30 seconds after imagewise exposure using a color-developing solution containing substantially no benzyl alcohol, a sulfite in a concentration of $8\times10^{-3}$ mol/liter or less, and a hydroxylamine salt in a concentration of $1.5\times10^{-2}$ mol/liter or less.

Though conventional color-developing solutions have disadvantages of generating stains and so on if concentrations of a sulfite and a hydroxylamine are decreased, it has very surprisingly now been found that sufficiently high color density of the developed image is obtained without increasing stain if color-development is processed in a short time using a color developing solution containing substantially no benzyl alcohol in accordance with the present invention.

In particular, these effects are remarkable in a photographic material containing a magenta coupler represented by formula (I) illustrated in detail below.

DETAILED DESCRIPTION OF THE INVENTION

A color-developing solution to be employed in the present invention contains substantially no benzyl alcohol. The expression "containing substantially no benzyl alcohol" as used herein is intended to include containing benzyl alcohol in a concentration of 2 ml/liter or less, preferably 0.5 ml/liter or less, and particularly preferably containing no benzyl alcohol at all.

The color developing time in accordance with the present invention is not more than 2 minutes and 30 seconds, and preferably from 30 seconds to 2 minutes. The expression "color developing time" as used herein means a period from the start of photographic material's contact with the color-developing solution till the start of contact with the next bath.

Specific examples of sulfites which can be used in the present invention include sodium sulfite, potassium sulfite, lithium sulfite, sodium bisulfite, potassium bisulfite, calcium bisulfite, magnesium bisulfite, strontium bisulfite, and so on. However, the present invention should not be construed as being limited to such compounds. These sulfites may be added to a developing solution individually or as a mixture of two or more thereof. The amount of such a sulfite to be added to a color developing solution is $8\times10^{-3}$ mol/liter or less, and preferably ranges from $1.6\times10^{-3}$ to $6.5\times10^{-3}$ mol/liter.

A hydroxylamine is to be used in the present invention.

Although it can be added to a color-developing solution in the form of a free amine, is generally added in the form of water-soluble acid salt. Typical examples of such acid salts include sulfates, chlorides, oxalates, phosphates, carbonates, acetates, and so on. The hydroxylamines may be substituted or unsubstituted, and the nitrogen atom in the hydroxylamines may be substituted with a methyl group and/or a hydroxymethyl group.

These hydroxylamines may be added to a color-developing solution individually or as a mixture of two or more thereof.

An amount of hydroxylamine to be added to a color-developing solution is $1.5\times10^{-2}$ mol/liter or less, preferably is not more than $3.8\times19^{-3}$ mol/liter, and particularly preferably is 0 mol/liter.

Magenta couplers which can be employed in accordance with a preferred embodiment of the present invention are represented by formula (I)

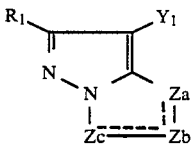

(I)

wherein $R_1$ represents a hydrogen atom or a substituent group; $Y_1$ represents a group capable of being released upon a coupling reaction with an oxidation product of an aromatic primary amine-developing agent; and Za, Zb, and Zc each represents an unsubstituted methine group, a substituted methine group, =N—, or —NH—, provided that either of the Za—Zb bond or the Zb—Zc bond is a double bond, and the other is a single bond.

The magenta couplers represented by formula (I) are described in more detail below.

In formula (I), $R_1$ represents a hydrogen atom or a substituent, and $Y_1$ represents a hydrogen atom or a group capable of being released upon a coupling reaction with an oxidation product of an aromatic primary amine-developing agent. Za, Zb, and Zc each represents an unsubstituted or substituted methine group, =N— or —NH—, provided that either of the Za—Zb bond or the Zb—Zc bond is a double bond, and the other is a single bond. When the Zb—Zc bond is a carbon-to-carbon double bond, it (i.e., Zb=Zc bond) may constitute part of a condensed aromatic ring. The magenta coupler represented by formula (I) may form a polymer (including a dimer) via $R_1$ or $Y_1$. Further, it may form a polymer (including a dimer) via Za, Zb, or Zc, provided that it represents a substituted methine group.

The term "polymer" as used herein with respect to formula (I) means a compound containing two or more of the groups represented by formula (I) in its molecule, and includes a bis compound and a polymeric coupler. The expresion "polymeric coupler" as used herein is intended to include not only a homopolymer prepared from only a monomer having the moiety represented by formula (I) (preferably those having a vinyl group, which are referred to as a vinyl monomer hereinafter), but also a copolymer prepared from the vinyl monomer and non-color-forming ethylenically unsaturated monomer which cannot undergo the coupling reaction with the oxidation product of an aromatic primary amine developing agent.

The compounds represented by formula (I) are nitrogen-containing heterocyclic 5-membered ring-condensed 5-membered ring type couplers. Their color-forming nuclei show aromaticity isoelectronic to naphthalene and have chemical structures inclusively referred to azapentalenes. The preferred compounds among the couplers represented by formula (I) include 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles and 1H-pyrazolo[1,5-a]benzimidazoles represented by formulae (II), (III), (IV), (V), (VI), and (VII) described below, respectively. Of these, the compounds represented by formulae (IV) and (V) are preferred, and the compound represented by formula (V) is particularly preferred.

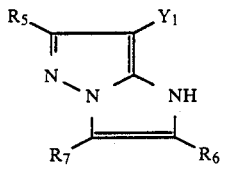

[II]

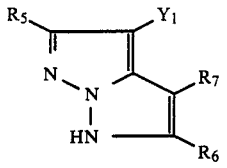

[III]

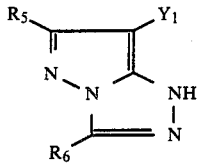

[IV]

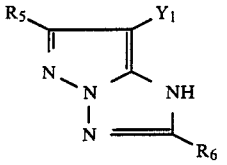

[V]

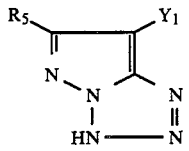

[VI]

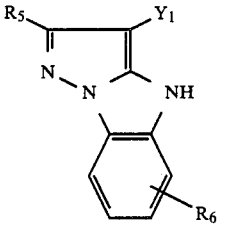

[VII]

In formulae (II), (III), (IV), (V), (VI), and (VII), $R_5$, $R_6$ and $R_7$ (which may be the same or different) each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and $Y_1$ represents a hydrogen atom, a halogen atom, a carboxyl group or a coupling releasable group capable of being released upon coupling by being bonded with the carbon atom located at the coupling position through an oxygen atom, a nitrogen atom or a sulfur atom.

Alternatively, $R_5$, $R_6$, $R_7$ or $Y_1$ represents a divalent group forming a bis coupler. Further, the coupler represented by formula (II), (III), (IV), (V), (VI), or (VII) may be in the form of a polymeric coupler in which the coupler constitutes a partial structure of a vinyl monomer and $R_5$, $R_6$ or $R_7$ represents a chemical bond or a connecting group, through which the partial structure of the formula (II), (III), (IV), (V), (VI), or (VII) and the vinyl group are connected together.

In more detail, $R_5$, $R_6$ and $R_7$ each represents a hydrogen atom, a halogen atom (e.g., chlorine atom, a bromine atom, etc.), an alkyl group (e.g., a methyl group, a propyl group, a tert-butyl group, a trifluoromethyl group, a tridecyl group, a 3-(2,4-di-tert-amylphenoxy)-propyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-tert-butylphenyl group, a 2,4-di-tert-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-tert-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino (e.g., an acetamido group, a benzamido group, a tetradecanamido group, an α-(2,4-di-tertamylphenoxy)-butylamido group, a γ-(3-tert-butyl-4-hydroxyphenoxy)butylamido group, an α-[4-(4-hydroxyphenylsulfonyl)phenoxy]decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-tert-butyl-4-hydroxyphenoxy)dodecanamido]anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-tert-butylphenoxy)propylthio group, etc.), an arylthio group (e.g., a phenylthio group, a 2-butoxy-5-tert-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group, (e.g., a phenoxycarbonylamino group, a 2,4-di-tert-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-tert-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)propyl]carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecyloxycarbonyl group, an octadecyloxycarbonyl group, etc.) or an aryloxycarbonyl group (e.g., a phenyloxycarbonyl group, a 3-pentadecylphenyloxycarbonyl group, etc.); and $Y_1$ represents a halogen atom (e.g., a chlorine atom, a bromine atom, an iodine atom, etc.); a carboxyl group; a group bonded to the coupling position through an oxygen atom (e.g., an acetoxy group, a propanoyloxy group, a benzoyloxy group, a 2,4-dichlorobenzoyloxy group, an ethoxyoxaloyloxy group, a pyruvinyloxy group, a cinnamoyloxy group, a phenoxy group, a 4-cyanophenoxyl group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.); a group bonded to the coupling position through a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzyl-5-ethoxy-3-hydantoinyl group, a 2N-1,1-dioxo-3-(2H)-oxo-1,2-benzisothiazolyl group, a 2-oxo-1,2-dihydro-1-pyridinyl group, an imidazolyl group, a pyrazoloyl group, a 3,5-diethyl-1,2,4-triazol-1-yl group, a 5- or 6-bromobenzotriazol-1-yl group, a 5-methyl-1,2,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, a 4-methoxyphenylazo group, a 4-pivaloylaminophenylazo group, a 2-hydroxy-4-propanoylphenylazo group, etc.); or a group bonded to the coupling position through a sulfur atom (e.g., a phenylthio group, a 2-carboxyphenylthio group, a 2-methoxy-5-tertoctylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

When $R_5$, $R_6$, $R_7$, or $Y_1$ each represents a divalent group to form a bis coupler, such a divalent group includes a substituted or unsubstituted alkylene group (e.g., a methylene group, an ethylene group, a 1,10-decylene group, $—CH_2CH_2—O—CH_2CH_2—$, etc.), a substituted or unsubstituted phenylene group (e.g., a 1,4-phenylene group, a 1,3-phenylene group,

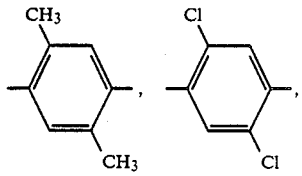

etc.), an —NHCO—$R_8$— group (wherein $R_8$ represents a substituted or unsubstituted alkylene or phenylene group), or a —CONH— group.

The connecting group represented by $R_5$, $R_6$, or $R_7$ in the cases wherein the coupler moiety represented by formula (II), (III), (IV), (V), (VI), or (VII) is included in a vinyl monomer includes an alkylene group (including a substituted or unsubstituted alkylene group, e.g., a methylene group, an ethylene group, a 1,10-decylene group, $—CH_2CH_2—O—CH_2CH_2—$, etc.), a phenylene group (including a substituted or unsubstituted phenylene group, e.g., a 1,4-phenylene group, a 1,3-phenylene group,

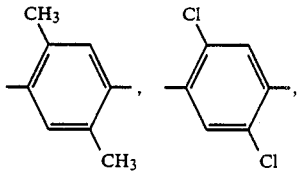

etc.), —NHCO—, —CONH—, —O—, —OCO—, and an aralkylene group (e.g.,

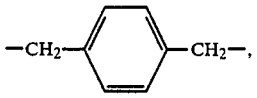

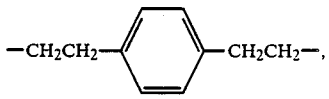

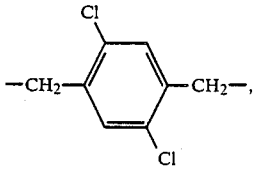

etc.), or a combination thereof.

Further, a vinyl group in the vinyl monomer may further have other substituents in addition to the coupler moiety represented by formula (II), (III), (IV), (V), (VI) or (VII). Preferred examples of the substituents include a hydrogen atom, a chlorine atom or a lower alkyl group having from 1 to 4 carbon atoms.

Examples of non-color-forming ethylenically unsaturated monomers which do not undergo coupling with the oxidation product of an aromatic primary amine developing agent include an acrylic acid and derivatives thereof such as acrylic acid, α-chloroacrylic acid, an α-aracrylic acid (e.g., methacrylic acid, etc.), etc., an ester or an amide derived from these acrylic acids (e.g., acrylamide, n-butylacrylamide, tert-butylacrylamide, diacetoneacrylamide, methacrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, β-hydroxy methacrylate, etc.), methylenedibisacrylamide, a vinyl ester (e.g., vinyl acetate, vinyl propionate, vinyl laurate, etc.), acrylonitrile, methacrylonitrile, an aromatic vinyl compound (e.g., styrene and derivatives thereof, vinyltoluene, divinylbenzene, vinylacetophenone, sulfostyrene, etc.), itaconic acid, citraconic acid, crotonic acid, vinylidene chloride, a vinyl alkyl ether (e.g., vinyl ethyl ether, etc.), maleic acid, maleic anhydride, a maleic acid ester, N-vinyl-2-pyrrolidone, N-vinylpyridine, 2-, or 4-vinylpyridine, etc.

Two or more non-color-forming ethylenically unsaturated monomers can be used together.

Of the couplers of the formulae (II) to (VII), the couplers of the formulae (IV) and (V) are preferable and the coupler for the formula (V) is the most preferable. In these formulae (IV) and (V), at least one of $R_5$ and $R_6$ is preferably a branched substituted or unsubstituted alkyl group, that is, an alkyl group or a substituted alkyl group which is connected to a pyrazoloazole skeleton through a secondary or tertiary carbon atom, wherein a secondary carbon atom means a carbon atom to which only one hydrogen atom is directly connected, and a tertiary carbon atom means a carbon atom to which no hydrogen atom but preferably an alkyl group or a substituted alkyl group is directly connected. The examples of the substituted alkyl group are a sulfonamidoalkyl group, a sulfonamidoarylalkyl group, a sulfonylalkyl group and the like.

As a magenta coupler of formula (I), it is also preferred to use couplers represented by formula (VIII) or (IX):

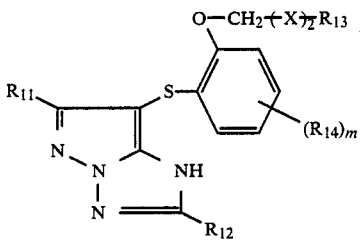

(VIII)

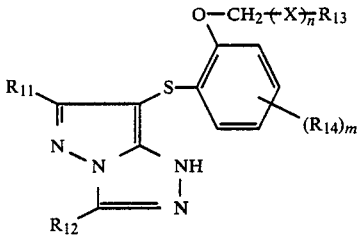

(IX)

wherein $R_{11}$ and $R_{12}$ each represents a substituent as defined by $R_5$, at least one of said $R_{11}$ and $R_{12}$ representing a group bonding to the pyrazoloazole nucleus by a nitrogen atom, oxygen atom, or sulfur atom thereof as exemplified before; X represents $-CH_2-O-$, $-CH_2O-CH_2CH_2O-$, $-CH_2SO_2-$, $-CH_2CH_2CH_2SO_2NH-$, $-CH_2CH_2CH_2SO_2NHCH_2CH_2O-$, $-CH_2CH_2CONH-$, $-CH_2-COO-$, $-CH_2CONH-$, $-CH_2CH_2CH_2CONH-$, $-CH_2CH_2SO_2-$, $-CH_2CH_2SO_2NH-$, $-CH_2CH_2NHSO_2-$, $-CH_2NHSO_2-$, $-CH_2NHCO-$, $-CH_2CH_2NHCO-$, $-\underset{\underset{O}{\|}}{C}-O-$, $-\underset{\underset{O}{\|}}{C}-$, $-SO_2-$, $-SO_2NH-$,

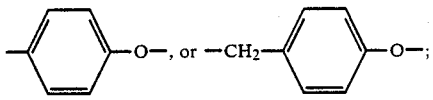

$R_{13}$ represents an alkyl group or an aryl group; $R_{14}$ represents a halogen atom, an alkoxy group, an alkyl group, an aryl group, a hydroxyl group, an amino group, an N-alkylamino group, an N,N-dialkylamino group, an N-anilino group, an acylamino group, a ureido group, an alkoxycarbonylamino group, an imido group, a sulfonamido group, a sulfamoylamino group, an alkoxycarbonyl group, a carbamoyl group, an acyl group, a cyano group, or an alkylthio group; n represents 0 or 1; m represents 0 or an integer of 1 to 4; and when m is 2 or more, said $R_{14}$ groups may be the same or different. As specific examples of the alkyl group, the aryl group, etc. represented by $R_{13}$ or $R_{14}$, those of the alkyl group, the aryl group, etc. as enumerated for formula (I) described above can be exemplified.

In the preferred compounds represented by formula (VIII), $R_{11}$ is an alkoxy group, a ureido group, or an aryloxy group, and $R_{12}$ is an alkyl group.

Also, in the preferred compounds represented by formula (IX), $R_{11}$ is an alkyl group or an alkoxy group, and $R_{12}$ is an alkylthio group.

Specific examples of the magenta couplers represented by formulae (II), (III), (IV), (V), (VI) and (VII) which can be used in the present invention and methods for synthesis thereof are described in the following literature.

Compounds of formula (II) are described in Japanese patent application (OPI) No. 162548/84, etc., the compounds of formula (III) are described in Japanese patent application (OPI) No. 43659/85, etc., the compounds of formula (IV) are described in Japanese patent publication No. 27411/72, etc., the compounds of formula (V) are described in Japanese patent application (OPI) Nos. 171956/84 and 172982/85, etc., the compounds of formula (VI) are described in Japanese patent application (OPI) No. 33552/85, etc., and the compounds of formula (VII) are described in U.S. Pat. No. 3,061,432, etc., respectively.

In addition, highly color forming ballast groups as described, for example, in Japanese patent application (OPI) Nos. 42045/83, 214854/84. 177553/84, 177554/84 and 177557/84, etc., can be applied to any of the compounds represented by formula (II), (III), (IV), (V), (VI) or (VII) described above.

Specific examples of the pyrazoloazole type couplers which can be employed in the present invention are set forth below, but the present invention should not be construed as being limited thereto.

(M-1)
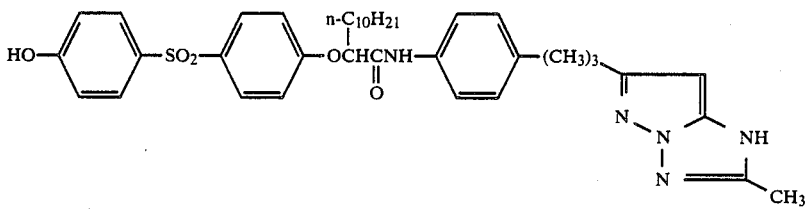
(M-2)
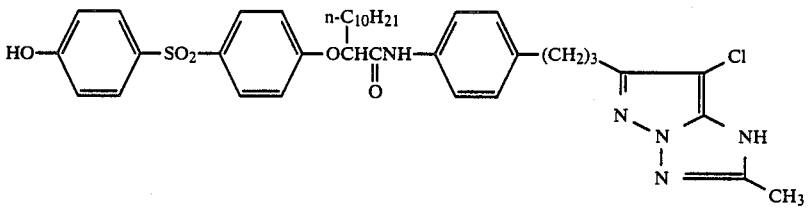
(M-3)
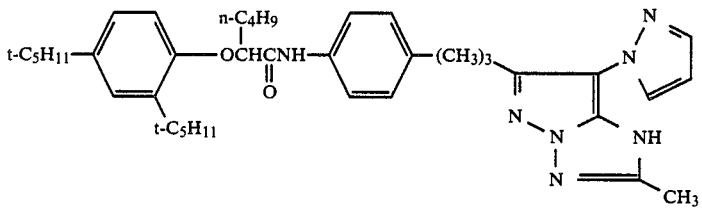
(M-4)
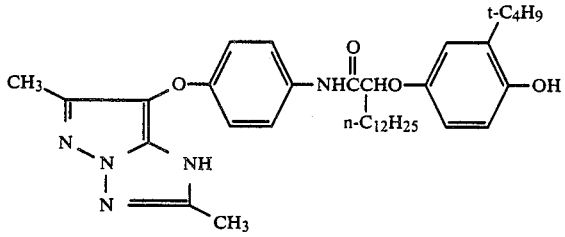
(M-5)
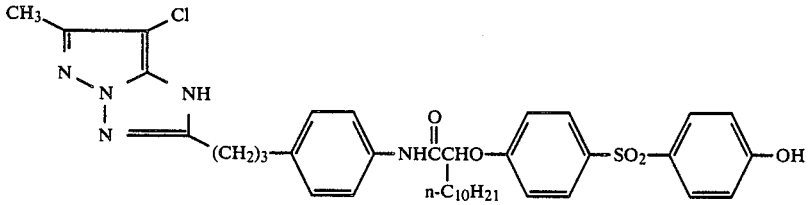
(M-6)
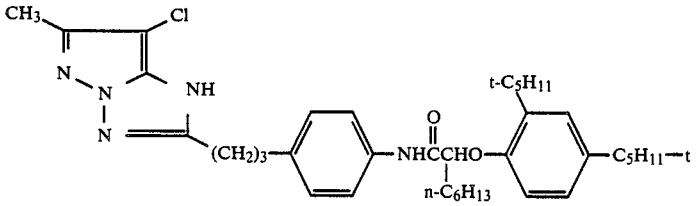
(M-7)
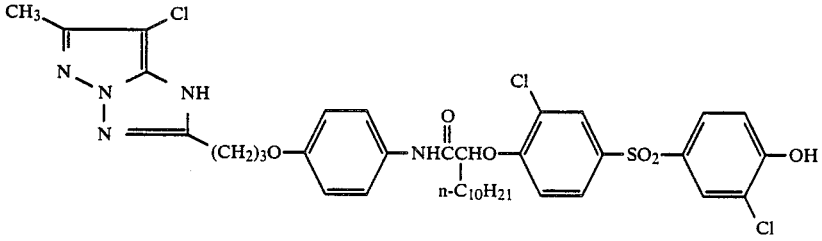

-continued
(M-8)
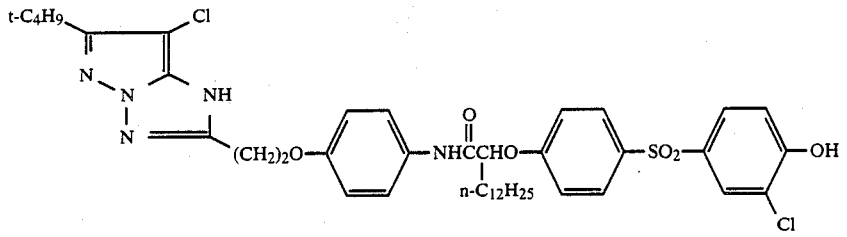
(M-9)
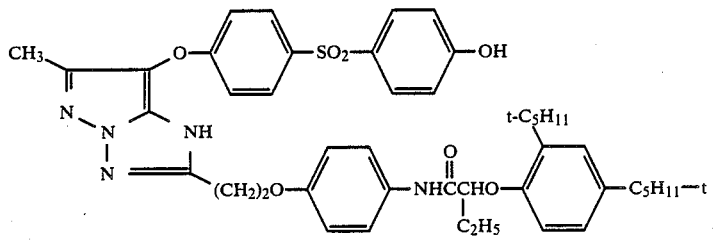
(M-10)
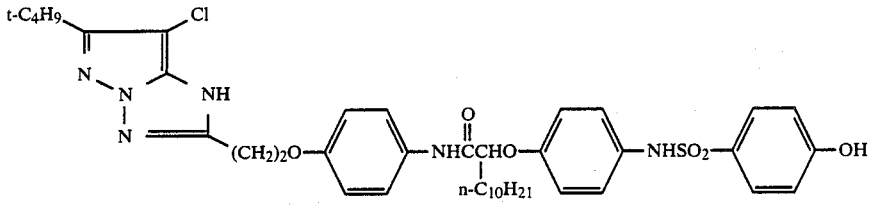
(M-11)
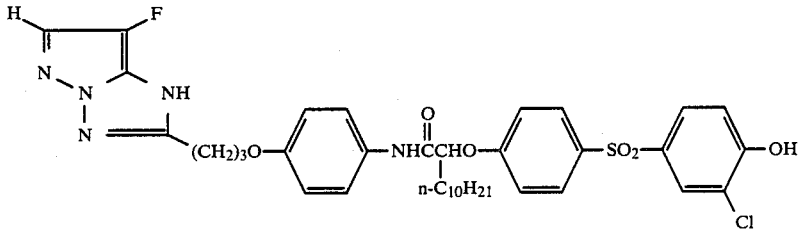
(M-12)
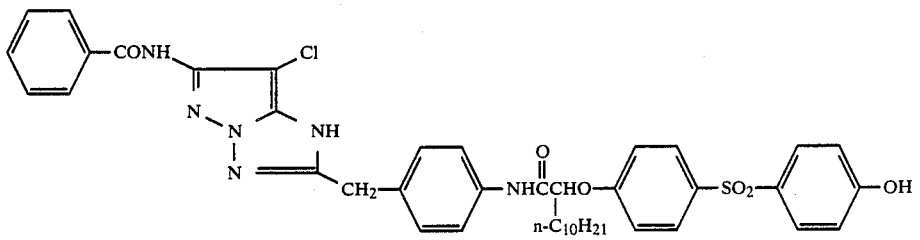
(M-13)
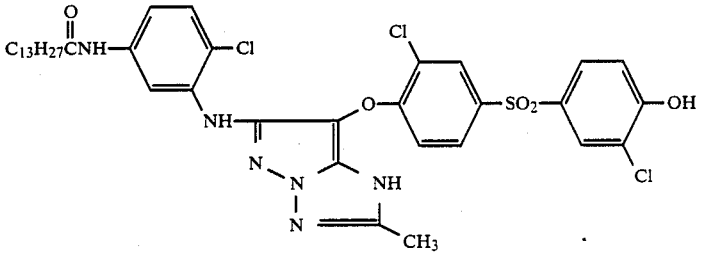

-continued
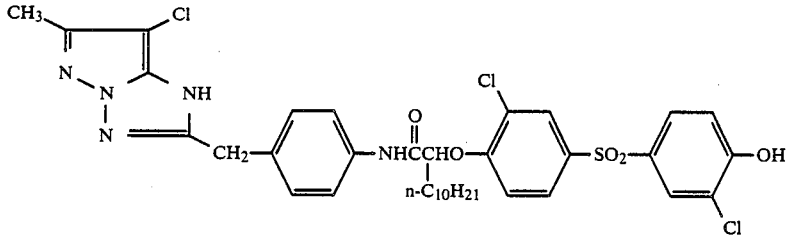
(M-14)
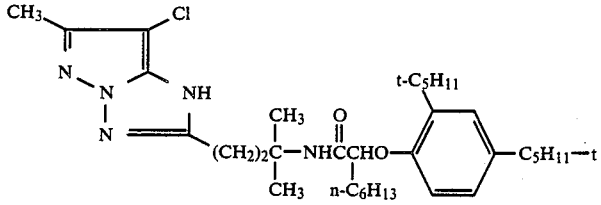
(M-15)
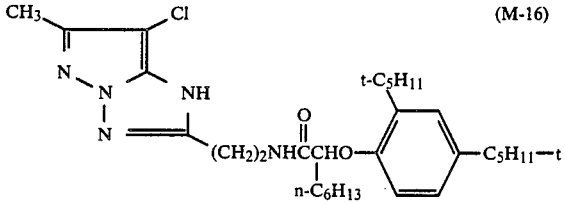
(M-16)
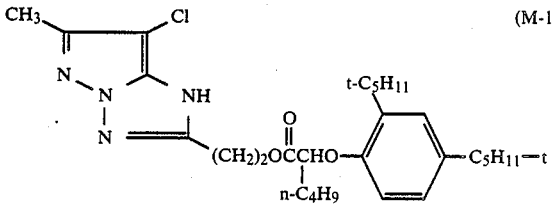
(M-17)
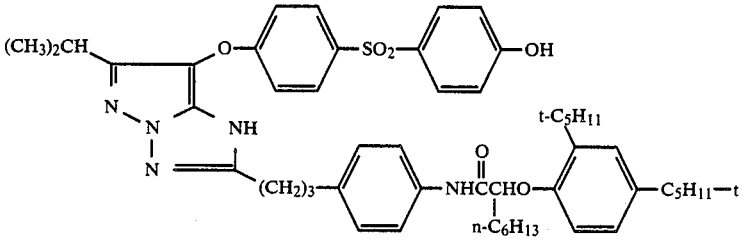
(M-18)
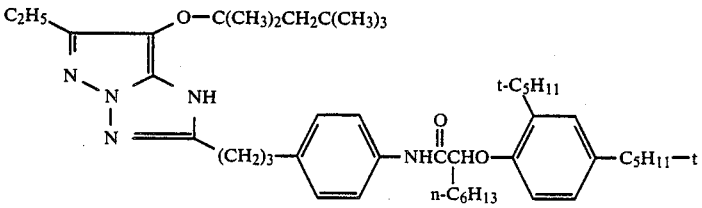
(M-19)
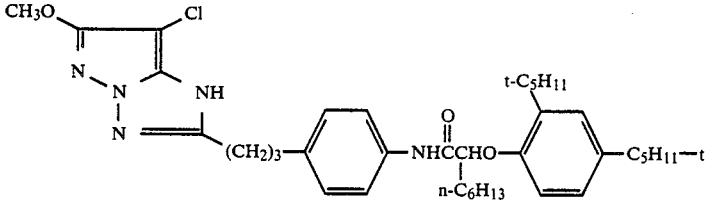
(M-20)
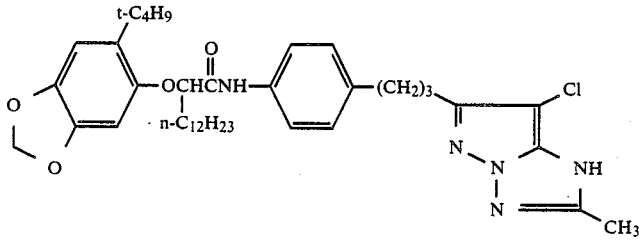
(M-21)

-continued
(M-22)
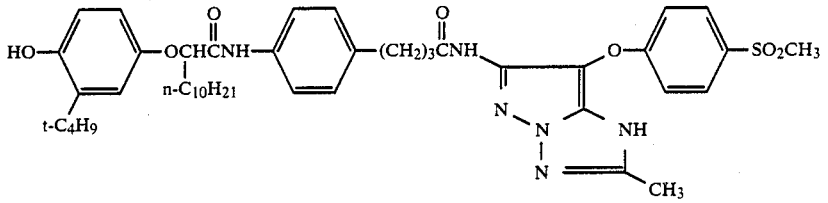
(M-23)
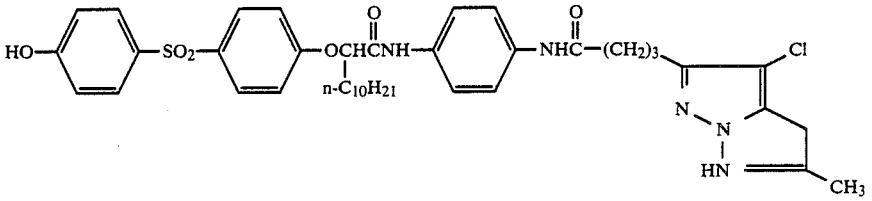
(M-24)
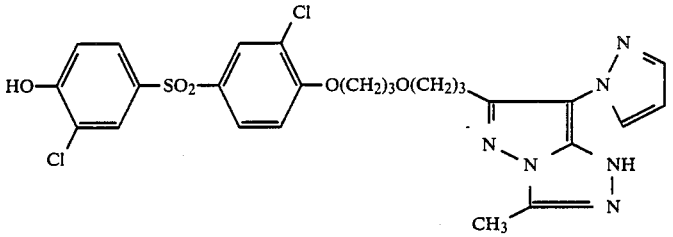
(M-25)
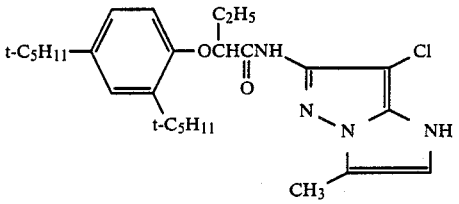
(M-26)
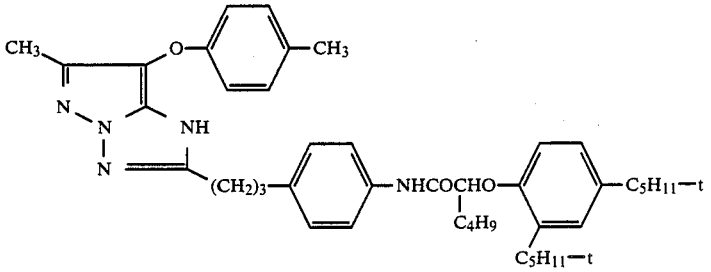
(M-27)
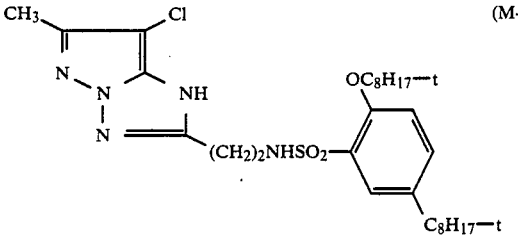
(M-28)
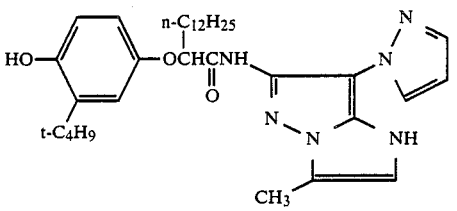
(M-29)
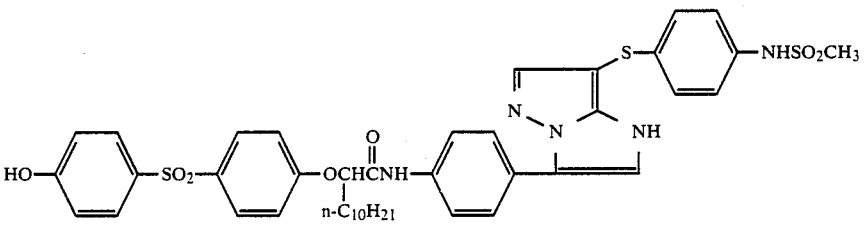

-continued
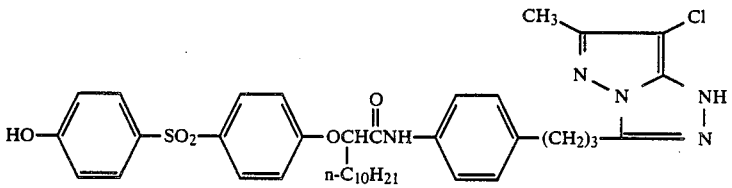
(M-30)
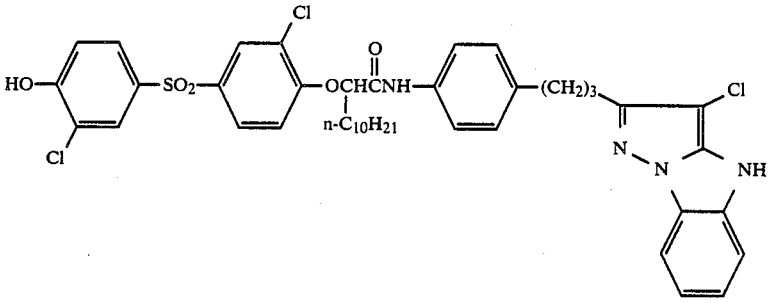
(M-31)
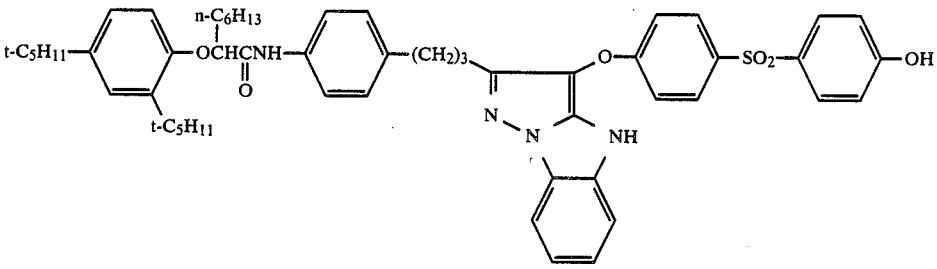
(M-32)
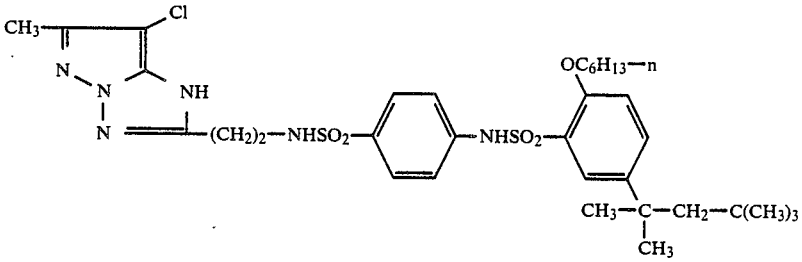
(M-33)
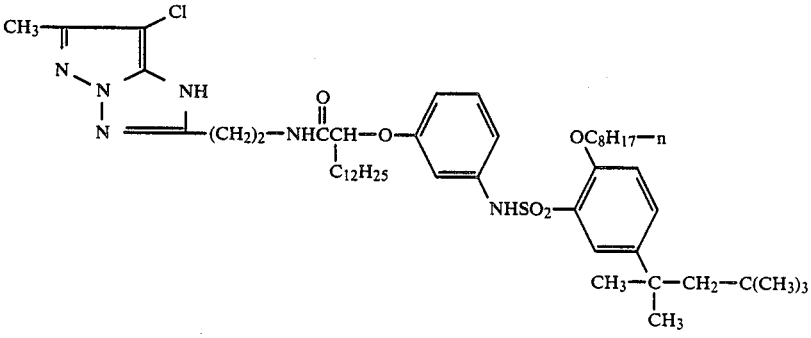
(M-34)

-continued
(M-35)
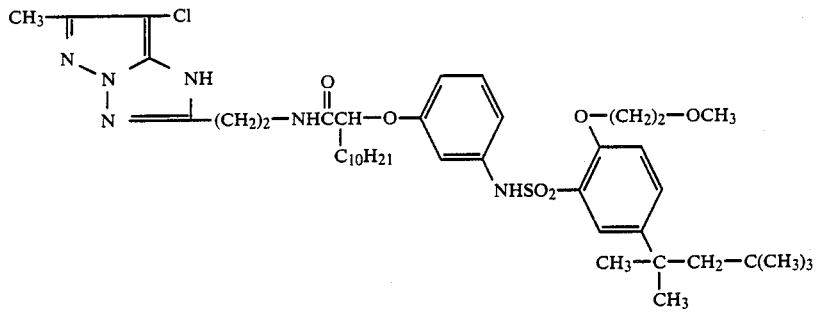
(M-36)
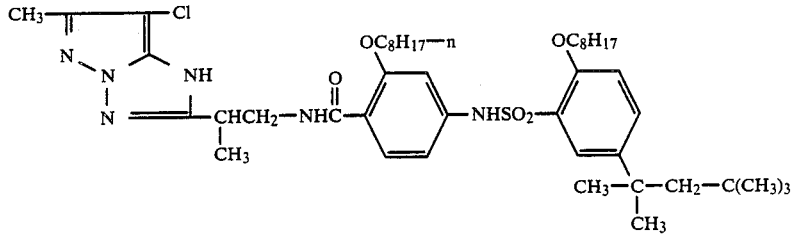
(M-37)
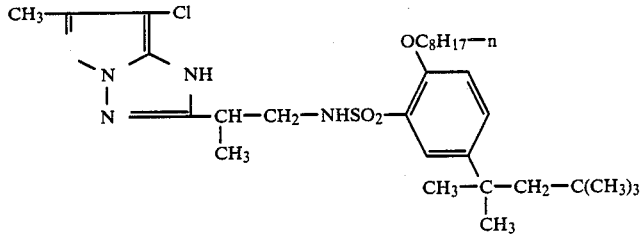
(M-38)
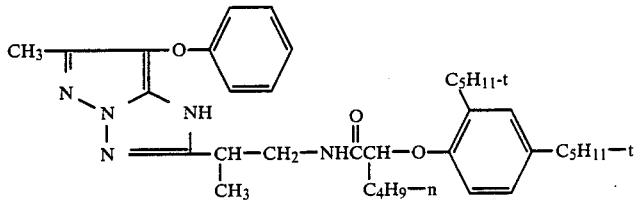
(M-39)
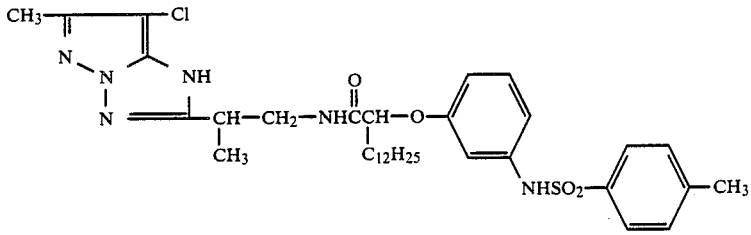
(M-40)
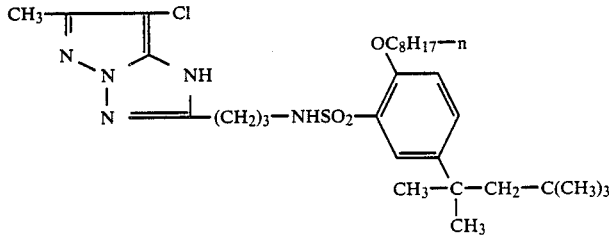

-continued
(M-41)
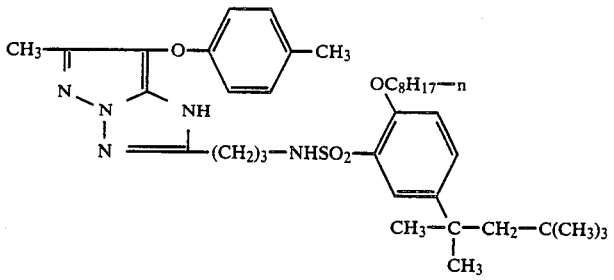
(M-42)
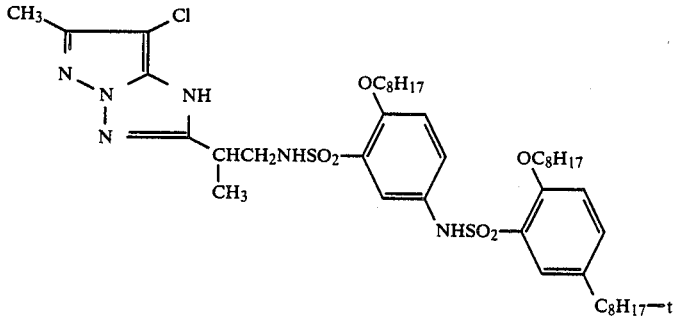
(M-43)
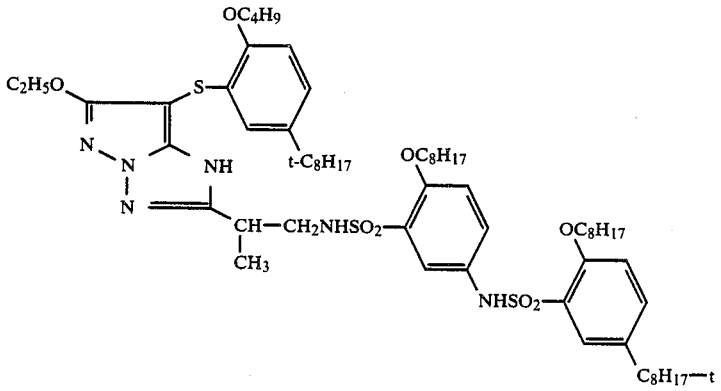
(M-44)
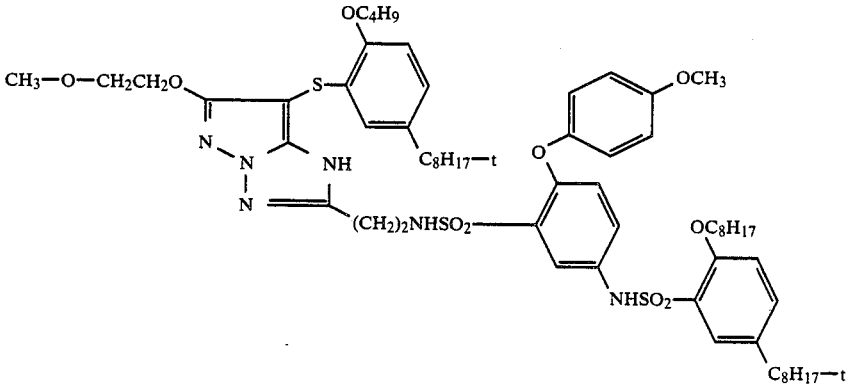

-continued
(M-45)
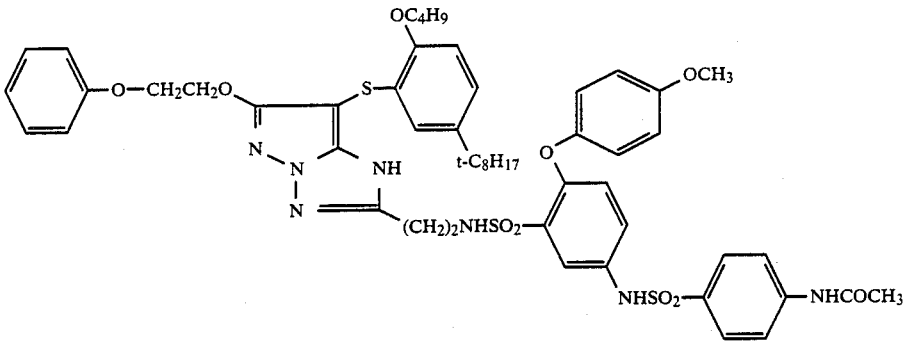
(M-46)
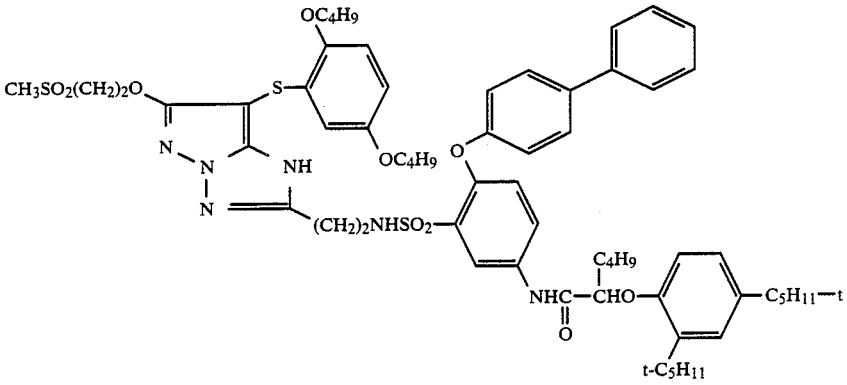
(M-47)
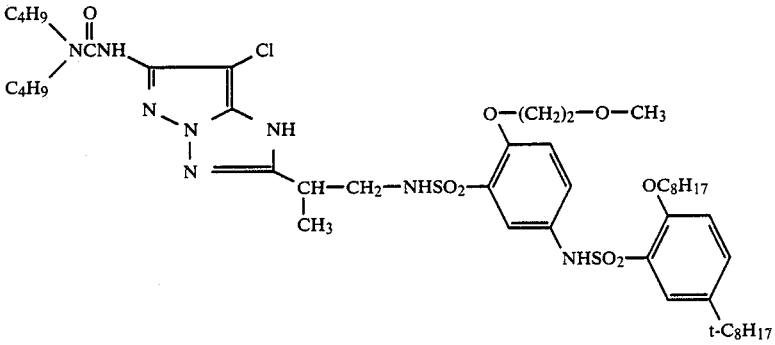
(M-48)
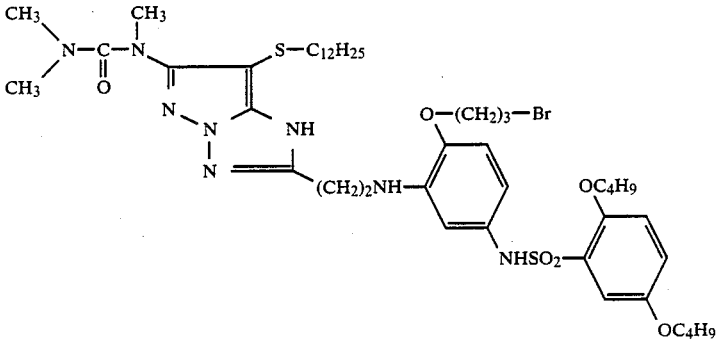

-continued
(M-49)
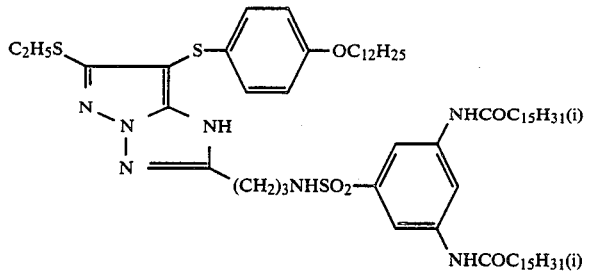
(M-50)
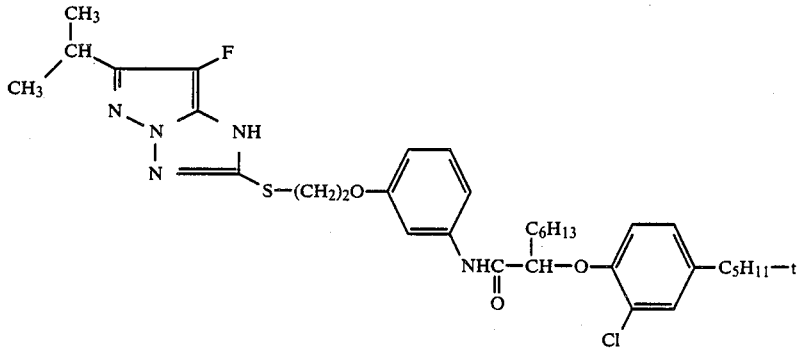
(M-51)
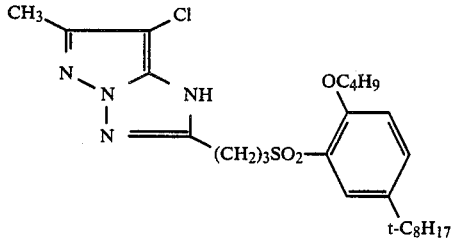
(M-52)
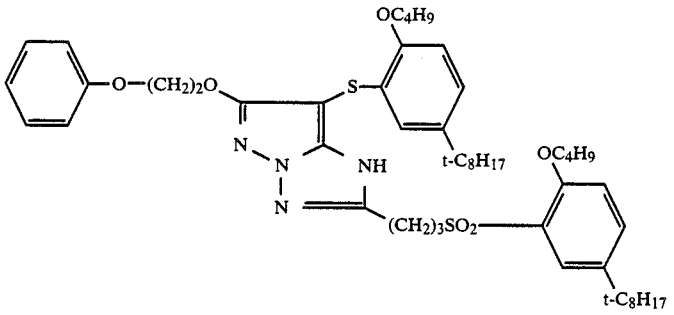
(M-53)
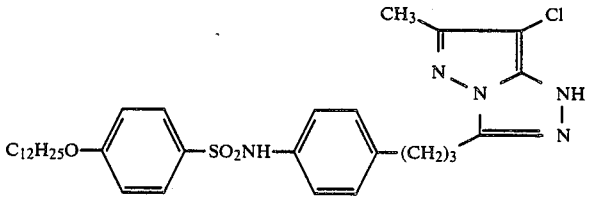

-continued
(M-54)
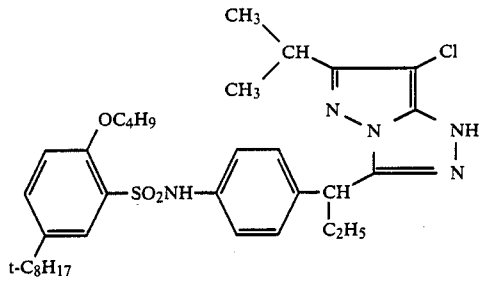
(M-55)
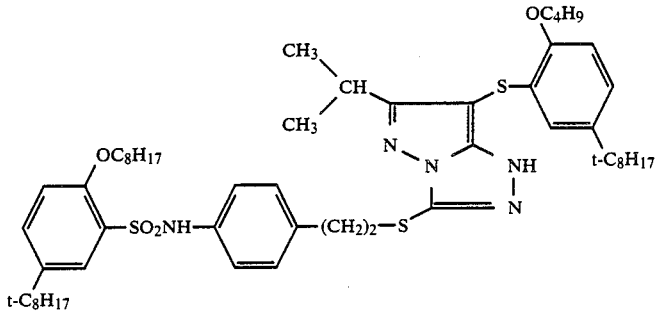
(M-56)
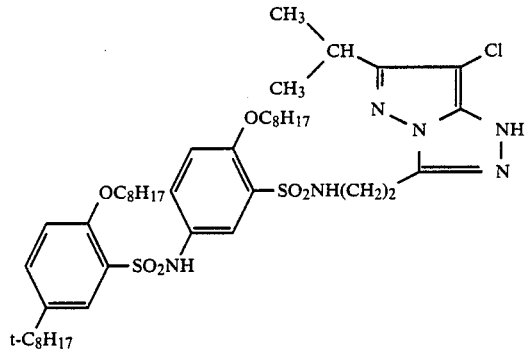
(M-57)
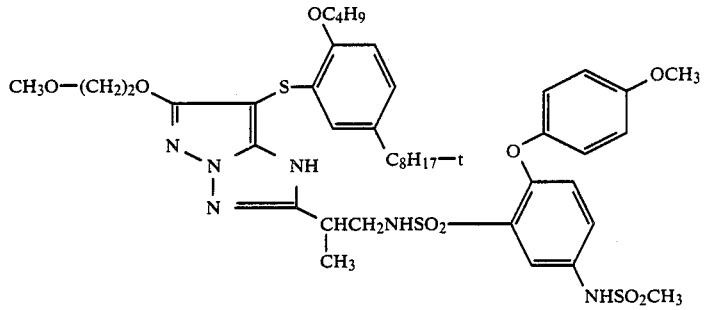
(M-58)
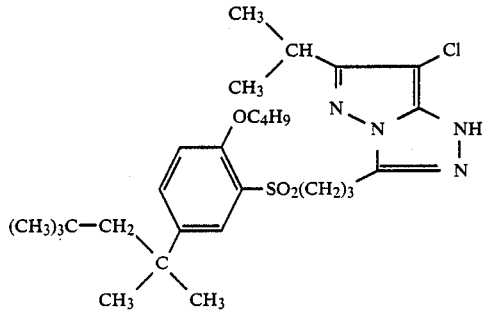

-continued
(M-59)
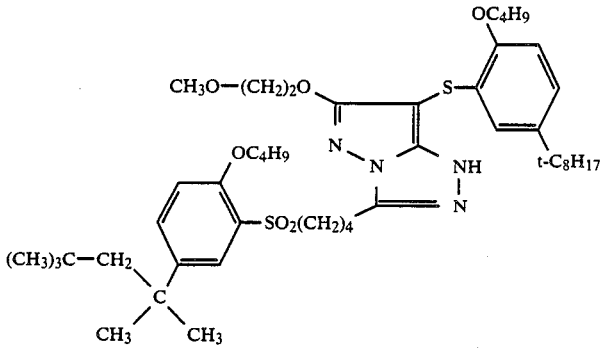
(M-60)
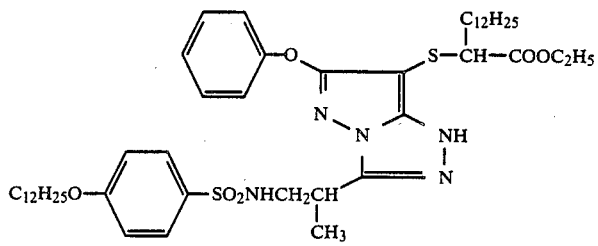
(M-61)
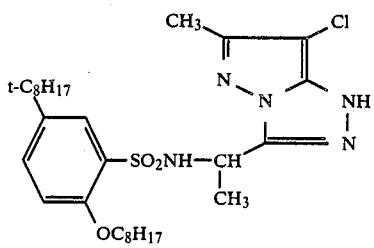
(M-62)
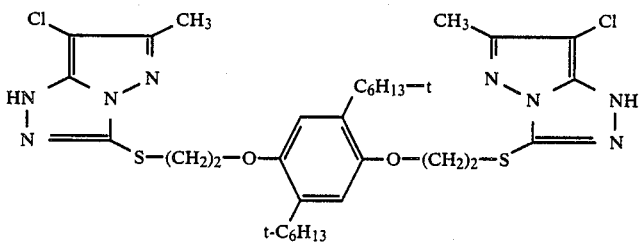
(M-63)
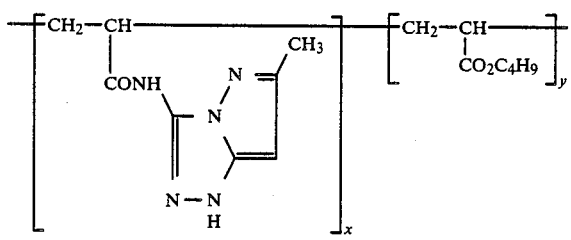
x/y = 50/50 (weight ratio)
(M-64)
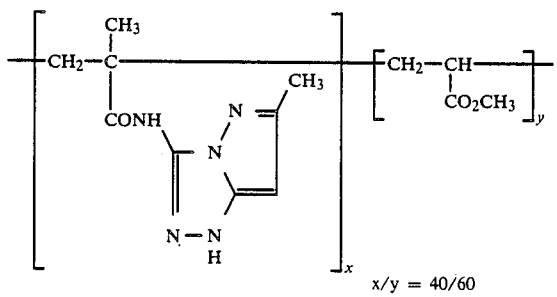
x/y = 40/60

-continued (M-65)

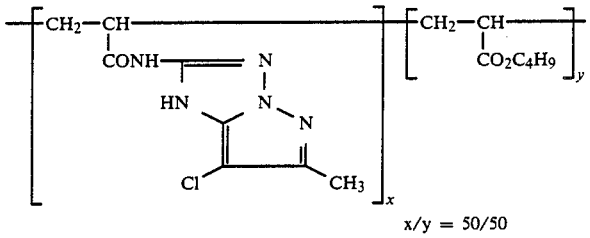

x/y = 50/50

(M-66)

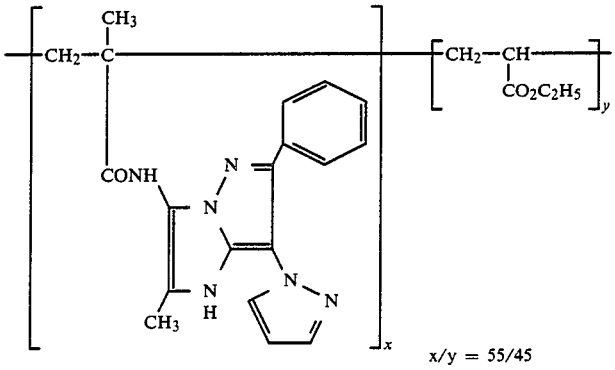

x/y = 55/45

(M-67)

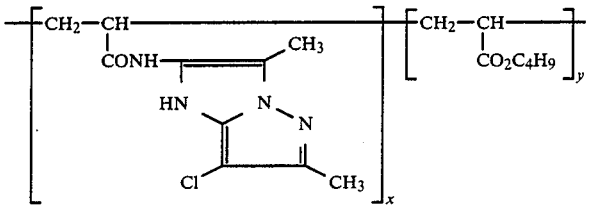

x/y = 50/50

The coupler may be incorporated into a silver halide emulsion layer in an amount of from $2\times10^{-3}$ to $5\times10^{-1}$ mol, and preferably from $1\times10^{-2}$ to $5\times10^{-1}$ mol, per mol of silver present in the emulsion layer.

In order to fulfill characteristics required for the light-sensitive material, two or more kinds of the couplers, etc., described above can be incorporated into the same layer, or the same compound may be incorporated into two or more layers.

In order to introduce couplers into a silver halide emulsion layer, known methods, for example, the method as described in U.S. Pat. No. 2,322,027, can be utilized. For example, they can be dissolved into a solvent and then dispersed into a hydrophilic colloid. Examples of solvents usable for this method include organic solvents having a high boiling point, such as alkyl esters of phthalic acid (e.g., dibutyl phthalate, dioctyl phthalate, etc.), phosphonic acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkylamides (e.g., diethyllaurylamides, etc.), fatty acid esters (e.g., dibutoxyethyl succinate, dioctyl azelate, etc.) and trimesic acid esters (e.g., tributyl trimesate, etc.); organic solvents having a boiling point of from about 30° to about 150° C., such as lower alkyl acetates (e.g., ethyl acetate, butyl acetate, etc.), ethyl propionate, secondary butyl alcohol, methyl isobutyl ketone, $\beta$-ethoxyethyl acetate, methyl cellosolve acetate; and the like. Mixtures of the organic solvents having a high boiling point described above and the organic solvents having a low boiling point described above can also be used.

A color-developing solution to be employed in the present invention is described below.

As has been noted hereinbefore, the color developing solution of the present invention contains substantially no benzyl alcohol. Of course, it is preferred that the color-developing solution should contain no benzyl alcohol at all.

In addition to sulfite and hydroxylamine salts, various preservatives can be added to the color-developing solution of the present invention, if desired.

Suitable examples of such preservatives include aromatic polyhydroxy compounds described in Japanese Patent Application (OPI) Nos. 49828/77, 47038/81, 32140/81 and 160142/84, and U.S. Pat. No. 3,746,544; hydroxyacetones described in U.S. Pat. No. 3,615,503 and British Pat. No. 1,306,176; $\alpha$-aminocarbonyl compounds described in Japanese patent application (OPI) Nos. 143020/77 and 89425/78; various metals described in Japanese patent application (OPI) Nos. 44148/82 and 53749/82; various sugars described in Japanese patent application (OPI) No. 102727/77; hydroxamic acids described in Japanese patent application (OPI) No. 27638/77, etc.; $\alpha,\alpha'$-dicarbonyl compounds described in Japanese patent application (OPI) No. 160141/84; salicylic acids described in Japanese patent application (OPI) No. 180588/84; alkanolamines described in Japanese patent application (OPI) No. 3532/79; poly(alkylene imines) described in Japanese patent application (OPI) No. 94349/81; gluconic acid derivatives described in Japanese patent application (OPI) No. 75647/81; and so on. These preservatives may be used in combinations of two or more thereof, if desired.

The color developing solution for use in the present invention contains an aromatic primary amine color developing agent. Preferred examples of the color developing agent are p-phenylenediamine derivatives. Specific examples thereof are illustrated below but the developing agents for use in the present invention are not limited by these compounds.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-Ethyl-N-(β-hydroxyethyl)amino]aniline
D-5: 2-Methyl-4-[N-ethyl-N-(β-hydroxyethyl-)amino]aniline
D-6: N-Ethyl-N-(β-methanesulfonamidoethyl)-3-methyl-4-aminoaniline
D-7: N-(2-Amino-5-diethylaminophenylethyl)methanesulfonamide
D-8: N,N-Dimethyl-p-phenylenediamine
D-9: 4-amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Also, the p-phenylenediamine derivative may be used as a form of the salt thereof, such as the sulfate, hydrochloride, sulfite, p-toluenesulfonate, etc.

The amount of the aromatic primary amine developing agent is from about 0.1 g of about 20 g, and preferably from about 0.5 to about 10 g, per liter of a developing solution.

In the color developing solution for use in the present invention, from viewpoint of the color forming property and the stability of hue and image, the compound of D-6 is particularly preferred.

The color developing solution is generally used at a pH of from 9 to 12, and preferably from 9 to 11.0, in the present invention.

The color developing solution may further contain other components generally used for color developing solutions. For example, sodium hydroxide, potassium hydroxide, sodium carbonate, potassium carbonate, sodium tertiary phosphate, potassium tertiary phosphate, potassium metaborate, borax, etc., are used alone or as a combination thereof as an alkali agent or a pH buffer. Also, various salts such as disodium hydrogenphosphate, dipotassium hydrogenphosphate, potassium dihydrogenphosphate, sodium dihydrogenphosphate, sodium bicarbonate, potassium bicarbonate, a borate, an alkali nitrate, an alkali sulfate, etc., can be used for imparting buffer faculty to the developing solution, for facilitating the preparation of the color developing solution, or for increasing the ionic strength.

Furthermore, the color developing solution may contain a chelating agent for preventing the precipitation of calcium, magnesium, etc., such as polyphosphates, aminopolycarboxylic acids, phosphonocarboxylic acids, aminopolyphosphonic acids, 1-hydroxyalkylidene-1,1-diphosphonic acids, etc.

If desired, the color developing solution may further contain a development accelerator such as the pyrimidium compounds described in U.S. Pat. Nos. 2,648,604 and 3,171,247, Japanese patent publication No. 9503/69, etc., other cationic compounds, cationic dyes (e.g., phenosafranine, etc.), neutral salts (e.g., thallium nitrate, potassium nitrate, etc.), polyethylene glycol and the derivatives thereof described in Japanese patent publication No. 9304/69, U.S. Pat. Nos. 2,533,990, 2,531,832, 2,950,970, 2,577,127, etc., nonionic compounds (e.g., polythioethers, etc.), and thioether compounds described in U.S. Pat. No. 3,201,242, etc. In particular, the thioether compounds and the 3-pyrazolidones are preferred.

Also, if desired, the color developing solution may contain an antifoggant. Examples of the antifoggant include alkali metal halides such as potassium bromide, sodium bromide, potassium iodide, etc., and organic antifoggants such as nitrogen-containing heterocyclic compounds (e.g., benzotriazole, 6-nitrobenzimidazole, 5-nitroindazole, 5-methylbenzotriazole, 5-nitrobenzotriazole, 5-chlorobenzotriazole, 2-thiazolylbenzimidazole, 2-thiazolylmethylbenzimidazole, hydroxyazaindolizine, etc.), mercapto-substituted heterocyclic compounds (e.g., 1-phenyl-5-mercaptotetrazole, 2-mercaptobenzimidazole, 2-mercaptobenzothiazole, etc.), and mercapto substituted aromatic compounds (e.g., thiosalicylic acid, etc.). The nitrogen-containing heterocyclic compounds are particularly preferred. The antifoggant may be accumulated in a color developing solution by dissolving out from color photographic materials during processing.

After color development, the silver halide color photographic material is usually bleached. The bleach processing may be performed simultaneously with a fix processing (bleach-fix or blix processing) or separately from a fix processing. As the bleaching agent, there are compounds of polyvalent metals such as iron (III), cobalt (III), chromium (VI), copper (II), etc., peracids, quinones, nitroso compounds, etc. Examples of the bleaching agent include the ferricyanides of the polyvalent metals, the bichromates of the polyvalent metals, organic complex salts of iron (III) or cobalt (III) (e.g., the complex salts of the metal and an aminopolycarboxylic acid such as ethylenediaminetetraacetic acid, diethylenetriaminepentaacetic acid, 1,3-diamino-2-propanoltetraacetic acid, etc., or other organic acid such as citric acid, tartaric acid, malic acid, etc.), persulfates, manganates, nitrosophenol, etc. In these materials, ethylenediaminetetraacetic acid iron (III) complex salt, 1,3-diaminopropanetetraacetic acid iron (III) complex salt, diethylenetriaminepentaacetic acid iron (III) complex salt, and a cyclohexanediaminetetraacetic acid iron (III) are preferably used in the present invention, and also the combination use of these compounds is useful.

Also, if desired, the bleaching solution or the blixing solution may contain various kinds of bleach accelerators. Examples of the bleach accelerators are bromide ions, iodide ions, the thiourea compounds described in U.S. Pat. No. 3,706,561, Japanese patent publication Nos. 8506/70, 26586/74, Japanese patent application (OPI) Nos. 32735/78, 36233/78 and 37016/78, the thiol compounds described in Japanese patent application (OPI) Nos. 124424/78, 95631/78, 57831/78, 32736/78, 65732/78, 52534/79 and U.S. Pat. No. 3,893,858, the heterocyclic compounds described in Japanese patent application (OPI) Nos. 59644/74, 140129/75, 28426/78, 141623/78, 104232/78 and 35727/79, the thioether compounds described in Japanese patent application (OPI) Nos. 20832/77, 25064/80 and 26506/80, the quaternary amines described in Japanese patent application (OPI) No. 84440/73, and the thiocarbamoyls described in Japanese patent application (OPI) No. 42349/74.

The blixing solution or a fixing solution contains a fixing agent such as thiosulfates, thiocyanates, thioether compounds, thioureas, iodides, etc. In these fixing agents, thiosulfates are most generally used. It is preferred that the blixing solution or the fixing solution further contains a preservative such as a sulfite, a hydrogensulfite, a carbonyl hydrogensulfite addition product, etc.

After blix processing or fix processing, the color photographic material is usually subjected to wash processing. For the wash processing step, various kinds of compounds can be used for the purposes of preventing the occurrence of precipitation and saving water. Examples of such compounds are water softeners such as inorganic phosphoric acids, aminopolycarboxylic acids, organic phosphoric acids, etc., for preventing the occurrence of precipitations, germicides or gungicides for preventing the propagation of various bacteria, algae, and fungi, hardening agents such as magnesium salts and aluminum salts, and surface active agents for reducing the drying load or preventing uneven finishing.

Also, the compounds described in L. E. West, "Water Quality Criteria", *Photographic Science and Engineering*, Vol. 9, No. 6 (1965) may be used for the wash step. The chelating agents and fungicides described in the above literature are particularly effective. Furthermore, by employing a multistage (e.g., 2 to 5 stages) countercurrent system for the wash processing step, a significant amount of water can be saved.

Also, after the wash step or in place of the wash step, the multistage countercurrent stabilization step as described in Japanese patent application (OPI) No. 8543/82 can be used. In the case of the aforesaid step, the countercurrent step of 2 to 9 tanks is required.

The stabilizing bath may contain various kinds of compounds for stabilizing color images formed. Examples of the compounds are formalin or buffers for controlling the pH of the photographic layer(s) (e.g., borates, metaborates, borax, phosphates, carbonates, potassium hydroxide, sodium hydroxide, aqueous ammonia, monocarboxylic acids, dicarboxylic acids, polycarboxylic acids, etc.). Also, if desired, the stabilization liquid may further contain a water softener (e.g., inorganic phosphoric acids, aminopolycarboxylic acids, organic phosphoric acids, aminopolyphosphonic acids, phosphonocarboxylic acids, etc.), germicide (e.g., proxel, isothiazolone, 4-thiazolinebenzimidazole, halogenated phenols, etc.), a surface active agent, a brightening agent, a hardening agent, etc.

Still further, the stabilization liquid may further contain various ammonium salts such as ammonium chloride, ammonium nitrate, ammonium sulfate, ammonium phosphate, ammonium sulfite, ammonium thiosulfate, etc., for controlling the pH of the photographic layer(s) of the color photographic material after processing.

In the case of employing continuous processing in the process of the present invention, the occurrence of the deviation of the composition of each processing solution can be prevented by using a replenisher for the processing solution, whereby a constant finish is obtained. The amount of the replenisher can be reduced to a half or below a half of the standard amount of the replenisher used, thus reducing processing costs.

If desired, each processing tank may be equipped with a heater, a temperature sensor, a liquid level sensor, a circulating pump, a filter, a floating lid, a squeegee, a nitrogen gas stirrer, an air stirrer, etc.

The silver halide emulsion for use in the present invention contains silver bromide, silver chlorobromide, or silver chloride each containing substantially no silver iodide and contains preferably silver chlorobromide containing from 2 to 99 mol% of silver chloride.

The expression "silver halide containing substantially no silver iodide" as used herein is intended to include silver halides having a silver iodide content of 2 mol% or less, preferably 1 mol% or less, and particularly preferably 0 mol%.

In order to obtain a silver chlorobromide emulsion which can demonstrate sufficiently high sensitivity without causing an increase in fog, it is desired that silver bromide content in the emulsion should be 20 mol% or more. However, in some cases, particularly in the rapidity required case, desirable results can be obtained by using a silver chlorobromide emulsion having a silver bromide content of 20 mol% or less, or 10 mol% or less. The reduction of silver bromide content not only contributes to increasing rapidity of development, but also leads to a decrease in amount of bromine ion accumulated in a developing solution by subjecting the resulting photographic materials to a running processing, thereby enhancing the activity of the developing solution itself. Therefore, a reduced content of silver bromide is advantageous in the rapid processing.

The silver halide grains for use in the present invention may differ in composition or phase between the inside and the surface layer thereof, may have a multiphase structure having a junction structure, or may have a uniform phase or composition throughout the whole grain. Also, the silver halide grains may be composed of a mixture of these grains having different phase structures.

The mean grain size (the diameter of the grain when the grain is spherical or resembles spherical, or the mean value based on the project area using the edge length as the grain size when the grain is a cubic grain) of the silver halide grains for use in the present invention is preferably from 0.1 $\mu$m to 2 $\mu$m, and more preferably from 0.15 $\mu$m to 1 $\mu$m.

The grain size distribution of a silver halide emulsion for use in the present invention may be narrow or broad, but a so-called monodispersed silver halide emulsion wherein the value (fluctuation) obtained by dividing the standard deviation in the grain distribution curve by the mean grain size is within about 20%, and preferably within 15%, is preferably used in the present invention. Also, for satisfying the gradation required for a color photographic material, two or more kinds of monodispersed silver halide emulsions (preferably having the above-described fluctuation as the monodispersibility) can exist in an emulsion layer having substantially the same color sensitivity as a mixture thereof or exist in two or more emulsion layers, respectively, each having substantially the same color sensitivity. Furthermore, two or more kinds of polydispersed silver halide emulsions or a combination of a monodispersed emulsion and a polydispersed emulsion can be used in one emulsion layer as a mixture thereof or in two or more layers, respectively.

The silver halide grains for use in the present invention may have a regular crystal form such as cubic, octahedral, dodecahedral, tetradecahedral, etc., or an irregular crystal form such as spherical, or further a composite form of these crystal forms. Also, a tabular grain silver halide emulsion can be used in the present invention. In particular, a tabular grain silver halide emulsion wherein tabular silver halide grains having an aspect ratio (length/width) of at least 5, in particular, at least 8, account for at least 50% of the total project area of the silver halide grains may be used. The silver halide emulsion for use in the present invention may be a mixture of these emulsions containing silver halide grains each having different crystal form. Also, the silver halide grains may be of a surface latent image type capable of forming latent images mainly on the surfaces thereof or of an internal image type capable of forming latent images mainly in the inside thereof.

The silver halide photographic emulsions for use in the present invention can be prepared using the methods described, for example, in P. Glafkides, *Chimie et Physique Photographique* (published by Paul Montel, 1967); G. F. Duffin, *Photographic Emulsion Chemistry* (published by Focal Press, 1966); V. L. Zelikman et al., *Making and Coating Photographic Emulsion* (published by Focal Press, 1964), etc.

For example, the silver halide emulsions may be prepared by an acid method, a neutralization method, an ammonia method, etc. Also, as a method of reacting a soluble silver salt and soluble halide(s), a single jet method, a double jet method, or a combination thereof may be used. A so-called reverse mixing method capable of forming silver halide grains in the existence of excessive silver ions can be employed. As one system of the double jet method, a so-called controlled double jet method of keeping a constant pAg in a liquid phase of forming silver halide grains can also be employed. According to the method, a silver halide emulsion containing silver halide grains having a regular crystal form and almost uniform grain sizes can be obtained.

Furthermore, a silver halide emulsion prepared by a so-called conversion method including a step of converting a silver halide already formed into a silver halide having a less solubility product before the formation step of the silver halide grains is finished or a silver halide emulsion prepared by applying the similar halogen conversion to silver halide grains after finishing the formation step of the silver halide grains can also be used.

For the purposes of preventing a reciprocity law failure, obtaining a high sensitivity or controlling a gradation, the silver halide grains may also be formed, or physically ripened, in the presence of a cadmium salt, a zinc salt, a lead salt, a thallium salt, an iridium salt or a complex salt thereof, a rhodium salt or a complex salt thereof, an iron salt or a complex salt thereof, etc.

After the formation of silver halide grains, the silver halide emulsion thus obtained is usually subjected to physical ripening, subjected to desalting, and then subjected to chemical ripening before coating.

In this case, a silver halide solvent (e.g., ammonia, potassium rhodanate, and the thioethers and thione compounds described in U.S. Pat. No. 3,271,157, Japanese patent application (OPI) Nos. 12360/76, 82408/78, 144319/78, 100717/79, 155828/79, etc.) can be used for the precipitation, physical ripening, and chemical ripening of silver halide emulsions. For removing soluble salts from silver halide emulsion after physical ripening, a noodle washing method, a flocculation setting method, an ultrafiltration method, etc., can be used.

For the chemical sensitization of the silver halide emulsions for use in the present invention, a sulfur sensitization method using active gelatin or a sulfur-containing compound capable of reacting silver (e.g., thiosulfates, thioureas, mercapto compounds, rhodanines, etc.), a reduction sensitization method using a reducing material (e.g., stannous salts, amines, hydrazine derivatives, formamidinesulfinic acid, silane compounds, etc.), a noble metal sensitization method using a metal compound (e.g., gold complex salts and complex salts of metals belonging to group VIII of the Periodic Table, such as platinum, iridium, palladium, rhodium, iron, etc.) can be used individually or as a combination thereof.

Of the chemical sensitization methods described above, the sulfur sensitization method is preferably used.

The color photographic material which is processed by the process of the present invention has preferably at least one blue-sensitive emulsion layer, at least one green-sensitive emulsion layer and at least one red-sensitive emulsion layer, the silver halide emulsions of which are spectrally sensitized by methine dyes, etc., to have each color sensitivity. The dyes used for the purpose include cyanine dyes, merocyanine dyes, complex cyanine dyes, complex merocyanine dyes, holopolar cyanine dyes, hemicyanine dyes, styryl dyes, and hemioxonol dyes. The particularly useful dyes are cyanine dyes, merocyanine dyes and complex merocyanine dyes.

For the merocyanine dyes or complex merocyanine dyes can be applied 5-membered or 6-membered heterocyclic nuclei such as pyrazolin-5-one nuclei, thiohydantoin nuclei, 2-thiooxazolidine-2,4-dione nuclei, thiazolidine-2,4-dione nuclei, rhodanine nuclei, thiobarbituric acid nuclei, etc., as nuclei having a ketomethylene structure.

The above-described sensitizing dyes can be used singly or as a combination thereof. A combination of sensitizing dyes is frequently used for the purpose of super color sensitization. Specific examples of the super color sensitizing dyes are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Pat. Nos. 1,344,281, 1,507,803, Japanese patent publication Nos. 4936/68, 12375/78, Japanese patent application (OPI) Nos. 110618/77, 109925/77, etc.

Also, the use of 2-equivalent color couplers substituted by a releasable group can reduce the amount of silver for the color photographic materials as compared to 4-equivalent color couplers having a hydrogen atom at the coupling active group. Couplers giving colored dyes having a proper diffusibility, non-color-forming couplers, DIR couplers releasing a development inhibitor with coupling reaction, or DAR couplers releasing a development accelerator with coupling reaction can also be used in the present invention.

In the present invention, yellow couplers, magenta couplers (including the magenta couplers of formula (II) described hereinbefore), and cyan couplers can be used for the color photographic materials when the present invention is applied for multicolor photographic materials.

As the yellow couplers for use in the present invention, there are oil protect type acylacetamido couplers as the typical examples. Specific examples of these couplers are described in U.S. Pat. Nos. 2,407,210, 2,875,057, 3,265,506, etc. In the present invention, 2-equivalent yellow couplers are preferably used and specific examples of these yellow couplers are the oxygen atom-releasing type yellow couplers described in U.S. Pat. Nos. 3,408,194, 3,447,928, 3,933,501, 4,022,620, etc., and the nitrogen atom releasing type yellow couplers described in Japanese Patent Publication No. 10739/83, U.S. Pat. Nos. 4,401,752, 4,326,024, *Research Disclosure,* RD No. 18053 (April, 1979), British Pat. No. 1,425,020, West German patent application (OLS) Nos. 2,219,917, 2,261,361, 2,329,587, 2,433,812, etc. In these yellow couplers, α-pivaloylacetanilide couplers are excellent in fastness, in particular light fastness of colored dyes formed, while α-benzoylacetanilide couplers are excellent in coloring density.

In the present invention, the pyrazoloazole series magenta couplers are used as the magenta couplers. That is, oil protect type indazolone series or cyanoacetyl series, preferably 5-pyrazolone series magenta couplers and other pyrazoloazole series couplers, can be used together with the pyrazoloazole series couplers. As the 5-pyrazolone series magenta couplers which can be used together with or as a combination with the pyrazoloazole couplers, couplers substituted by an arylamino group or an acylamino group at the 3-position thereof are preferred from the viewpoint of the hue and coloring density of the colored dyes formed. Specific examples of these couplers are described in U.S. Pat. Nos. 2,311,082, 2,343,703, 2,600,788, 2,908,573, 3,062,653, 3,152,896, 3,936,015, etc. Also, as the releasable groups for the 2-equivalent 5-pyrazoline series couplers, the nitrogen atom-releasing groups described in U.S. Pat. No. 4,310,619 and the arylthio groups described in U.S. Pat. No. 4,351,897 are preferred. Furthermore, the 5-pyrazolone series magenta couplers having a ballast group described in European Pat. No. 73,636 give high coloring density.

Examples of pyrazoloazole series couplers include pyrazolobenzimidazoles described in U.S. Pat. No. 3,369,879, and preferably, pyrazolo[5,1-c][1,2,4]triazoles described in U.S. Pat. No. 3,725,067, pyrazolotetrazoles described in Research Disclosure, RD No. 24220 (June, 1984), and pyrazolopyrazoles described in ibid., RD No. 24230 (June, 1984). Of these couplers, imidazo[1,2-b]pyrazoles described in European Pat. No. 119,741, and more particularly, pyrazolo[1,5-b][1,2,4]triazoles described in European Pat. No. 119,860 are preferred over others from the viewpoint that color-forming dyes produced therefrom by development have slight side absorption in the yellow region and excellent fastness to light.

As the cyan couplers for use in the present invention, there are oil protect type naphthol series or phenol series cyan couplers. Specific examples of the naphthol series couplers include the cyan couplers described in U.S. Pat. No. 2,474,293 and preferably the oxygen atom-releasing type 2-equivalent naphthol series couplers described in U.S. Pat. Nos. 4,052,212, 4,146,396, 4,228,233 and 4,296,200. Also, specific examples of the phenol series cyan couplers are described in U.S. Pat. Nos. 2,369,929, 2,801,171, 2,772,162, 2,894,826, etc. Cyan couplers having high fastness to humidity and temperature are preferably used in the present invention and typical examples of these cyan couplers include the phenol series cyan couplers having an alkyl group of 2 or more carbon atoms at the meta-position of the phenol nucleus described in U.S. Pat. No. 3,772,002, the 2,5-diacylamino-substituted phenol series cyan couplers described in U.S. Pat. Nos. 2,772,162, 3,758,308, 4,126,396, 4,334,011, 4,327,173, West German patent application (OLS) No. 3,329,729, Japanese patent application (OPI) No. 166956/84, etc., and the phenol series couplers having a phenylureido group at the 2-position thereof and an acylamino group at the 5-position thereof described in U.S. Pat. Nos. 3,446,622, 4,333,999, 4,451,559 and 4,427,767.

In the present invention, by using couplers giving colored dyes having a proper diffusibility together with the aforesaid color couplers, the graininess of color images formed can be improved. Specific examples of the magenta couplers giving such diffusible dyes are described in U.S. Pat. No. 4,366,237 and British Pat. No. 2,125,570 and specific examples of yellow, magenta and cyan couplers of this type are described in European Pat. No. 96,570 and West German patent application (OLS) No. 3,234,533.

The dye-forming couplers or the above-described specific couplers for use in the present invention may form dimers or higher polymers. Typical examples of the polymerized dye-forming couplers are described in U.S. Pat. Nos. 3,451,820 and 4,080,211. Also, specific examples of the polymerized magenta couplers are described in British Pat. No. 2,102,173 and U.S. Pat. No. 4,367,282.

The various kinds of couplers for use in the present invention may be used for the same photographic layer of a color photographic material as a combination of two or more kinds thereof for meeting particular characteristics desired for a color photographic material, or the same kind of coupler may be used for two or more photographic layers for meeting desired characteristics.

The couplers to be employed in the present invention can be introduced into the light-sensitive material using an oil-in-water dispersion method. In the oil-in-water dispersion method, the couplers are dissolved in either a high-boiling point organic solvent having a boiling point of 175° C. or more, or a so-called auxiliary solvent having a low boiling point, or in a mixture of these solvents, and then dispersed finely into an aqueous medium like water or an aqueous gelatin solution in the presence of a surface active agent. Suitable examples of high-boiling point organic solvents are described in U.S. Pat. No. 2,322,027, and so on. The dispersion may be accompanied by phase inversion. Further, the auxiliary solvent used may be removed from the dispersion or decreased in content therein through distillation, noodle washing, ultrafiltration or so on, if desired, in preference to coating of the dispersion.

Specific examples of high boiling point organic solvents which can be used include phthalic acid esters (e.g., dibutyl phthalate, dicyclohexyl phthalate, di-2-ethylhexyl phthalate, decyl phthalate, etc.), phosphoric or phosphonic acid esters (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, etc.), benzoic acid esters (e.g., 2-ethylhexyl benzoate, dodecylbenzoate, 2-ethylhexyl-p-hydroxybenzoate, etc.), amides (e.g., diethyldodecanamide, N-tetradecylpyrrolidone, etc.), alcohols or phenols (e.g., isostearyl alcohol, 2,4-di-tert-amylphenol, etc.), aliphatic carboxylic acid esters (e.g., azelaic acid dioctyl ester, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffins, dodecylbenzene, diisopropylnaphthalene, etc.), and so on. As for the auxiliary solvents, organic solvents having a boiling point of about 30° C. or more, and preferably from about 50° C. to about 160° C. can be used. The typical examples include ethyl acetate, butyl acetate, ethyl propionate, methyl ethyl ketone, cyclohexanone, 2-ethoxyethyl acetate, dimethylformamide, and so on.

Specific examples of processes and effects of the latex dispersion method, and latexes employed as impregnant are described in U.S. Pat. No. 4,199,363, German Patent Application (OLS) Nos. 2,541,274 and 2,541,230, and so on.

The standard amount of the color coupler is in the range of from 0.001 to 1 mol per mol of light-sensitive silver halide of a silver halide emulsion and the preferred amount is from 0.01 to 0.5 mol for yellow coupler and from 0.002 to 0.3 mol for cyan coupler.

The color photographic materials for use in the present invention contain hydroquinone derivatives, aminophenol derivatives, amines, gallic acid derivatives, catechol derivatives, ascorbic acid derivatives, colorless compound-forming couplers, sulfonamidophenol derivatives, etc., as color fog preventing agents or color mixing preventing agents.

Also, the color photographic light-sensitive materials for use in the present invention may further contain organic anti-fading agents. Examples of such organic anti-fading agents include hindered phenols such as hydroquinones, 6-hydroxycoumarones, 5-hydroxycoumarans, spirochromans, p-alkoxyphenols, or bisphenols, gallic acid derivatives, methylenedioxybenzenes, aminophenols, hindered amines, and also the ether or ester derivatives obtained by silylating or alkylating the phenolic hydroxy groups of these compounds. Also, metal complexes such as (bissalicylaldoximate)-nickel complex and (bis-N,N-dialkyldithiocarbamate)-nickel complex can be used as anti-fading agent.

The use of the compound having both the moiety structure of hindered amine and hindered phenol in the same molecule as described in U.S. Pat. No. 4,268,593 for the color photographic materials give good results for preventing the deterioration of the yellow dye images by heat, humidity, and light. Also, for representing the deterioration of magenta dye images, particularly by light, the use of the spiroindanes described in Japanese Patent Application (OPI) No. 159644/81 or the chromans having a hydroquinone diether or monoether as a substituted described in Japanese patent application (OPI) No. 89835/80 gives preferred results.

For improving the stability of cyan images, in particular the light fastness thereof, it is preferred to use benzotriazole series ultraviolet absorbents for the color photographic materials. The ultraviolet absorbent may be co-emulsified with a cyan coupler.

The ultraviolet absorbent may be used in a coating amount sufficient for imparting light stability to the cyan dye images formed, but if too great of an amount of the agent is used, yellowing sometimes occurs at the unexposed portions (background portions) of color photographic light-sensitive material after processing, and hence the amount is in the range of usually from $1\times10^{-4}$ mol/m$^2$ to $2\times10^{-3}$ mol/m$^2$, preferably from $5\times10^{-4}$ to $1.5\times10^{-3}$ mol/m$^2$.

In an ordinary layer constitution of color photographic paper, an ultraviolet absorbent exists in one or preferably both layers disposed at both sides of a cyan coupler-containing red-sensitive silver halide emulsion layer. Also, when an ultraviolet absorbent is incorporated in an interlayer between a green-sensitive emulsion layer and a red-sensitive emulsion layer, the agent may be co-emulsified with a color mixing preventing agent. When an ultraviolet absorbent exists in a protective layer, another protective layer may be formed as the outermost layer and the protective layer may contain a matting agent, optionally having particle sizes. Moreover, the color photographic materials for use in the present invention may contain ultraviolet absorbents in hydrophilic colloid layers thereof.

Color photographic materials for use in the present invention may further contain water-soluble dyes in the hydrophilic colloid layers thereof as filter dyes or for the purposes of irradiation prevention, halation prevention, etc.

The color photographic materials for use in the present invention may further contain brightening agents such as stilbene series compounds, triazine series compounds, oxazole series compounds, coumarine series compounds, etc., in the photographic emulsion layers or other hydrophilic colloid layers. In this case, as the brightening agents, water-soluble brightening agents may be used or water-insoluble brightening agents may be used in a form of the dispersion thereof.

The processing process of the present invention can be applied to multilayer multicolor photographic materials having at least two photographic emulsion layers having different spectral sensitization on a support. A multilayer natural color photographic material usually has at least one red-sensitive emulsion layer, at least one green-sensitive emulsion layer, and at least one blue-sensitive emulsion layer on a support. The disposition order of these emulsion layers can be selected according to the intended use. Also, each emulsion layer described above may be composed of two or more emulsion layers, each having different sensitivities. Also, a light-insensitive layer may exist between two or more emulsion layers each having the same color sensitivity.

It is preferred that the color photographic material for use in the present invention has proper auxiliary layers (also referred to as "photograph-constituting layers) such as a protective layer or protective layers, interlayers, a filter layer, an antihalation layer, a backing layer, etc., in addition to silver halide emulsion layers.

As the binder or protective colloid which can be used for the silver halide emulsion layers, interlayers, etc., of the color photographic materials in the present invention, gelatin is advantageously used, but other hydrophilic colloids can also be used.

For example, there are proteins such as gelatin derivatives, graft polymers of gelatin and other polymers, albumin, casein, etc.; cellulose derivatives such as hydroxyethyl cellulose, carboxymethyl cellulose, cellulose sulfates, etc.; saccharose derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As gelatin, lime-processed gelatin as well as acid-processed gelatin or the enzyme-processed gelatin as described in *Journal of the Society of Photographic Science and Technology of Japan,* No. 16, p. 30 (1966) can be used. Also, the hydrolyzed products or enzyme decomposed products of gelatin can be used.

The color photographic materials for use in the present invention may further contain various stabilizers, stain preventing agents, developing agents or precursors thereof, development accelerators or precursors thereof, lubricants, mordants, matting agents, antistatic agents, plasticizers and other additives useful for the color photographic materials in addition to the above-described additives. Examples of these additives are described in *Research Disclosure,* RD No. 17643 (December, 1978) and ibid., RD No. 18716 (November, 1979).

The process of the present invention can preferably be applied to a color photographic material having a reflective support. The reflective support has a high reflectivity for clearly viewing dye images formed in silver halide emulsion layers of the color photographic material. Such a reflective support comprises a support coated with a hydrophobic resin having dispersed therein a light reflective material such as titanium oxide, zinc oxide, calcium carbonate, calcium sulfate, etc., and a support composed of a hydrophobic resin having dispersed therein a light reflective material as described above. Examples of the reflective support include baryta-coated papers, polyethylene-coated papers, polypropylene series synthetic papers, and transparent supports (e.g., glass plates, polyester films such as polyethylene terephthalate films, cellulose triacetate films, or cellulose nitrate films, polyamide films, polycarbonate films, polystyrene films, etc.) having a reflective layer or containing a reflective material. These supports can be appropriately selected according to the intended purposes.

The following examples are intended to illustrate the present invention but not to limit it in any way.

EXAMPLE 1

Each of multi-layer color photographic paper (Samples (A) to (E)) was prepared by forming the layers having the composition shown below on a paper support both surfaces of which were coated with polyethylene. The coating compositions for the layers were prepared as follows.

Coating Composition for First Layer

In a mixture of 27.2 ml of ethyl acetate and 7.9 ml of Solvent (c) were dissolved 19.1 g of Yellow Coupler (a) and 4.4 g of Color Image Stabilizer (b) and the solution thus obtained was dispersed by emulsification in 185 ml of an aqueous 10 wt% gelatin solution containing 8 ml of a 10 wt% sodium dodecylbenzenesulfonate solution. On the other hand, 90 g of a silver chlorobromide emulsion (containing 80 mol% silver bromide and 70 g/kg of silver) containing the blue-sensitive sensitizing dye shown below in an amount of $7.0\times10^{-4}$ mol per mol of silver chlorobromide was prepared. The emulsified dispersion prepared above was mixed with the aforesaid silver halide emulsion and the gelatin concentration was adjusted as shown below to provide the coating composition fo the first layer. Coating compositions for the second layer to the seventh layer were also prepared by the same manner as in the first layer. As a gelatin hardening agent for each layer, 2,4-dichloro-6-hydroxy-s-triazine sodium salt was used.

The compositions of the layers were as follows. In addition, the polyethylene-coated paper contained titanium dioxide as a white pigment and ultramarine as a bluish dye.

| | |
|---|---|
| First Layer: Blue-Sensitive Emulsion Layer | |
| Mixed silver chlorobromide emulsion (silver bromide: 80 mol %) | 0.30 g/m$^2$ as Ag (silver content) |
| Gelatin | 1.86 g/m$^2$ |
| Yellow Coupler (a) | 0.82 g/m$^2$ |
| Color Image Stabilizer (b) | 0.19 g/m$^2$ |

-continued

| | |
|---|---|
| Solvent (c) | 0.34 ml/m$^2$ |
| Second Layer: Color Mixing Preventing Layer | |
| Gelatin | 0.99 g/m$^2$ |
| Color Mixing Preventing Agent (d) | 0.08 g/m$^2$ |
| Third Layer: Green-Sensitive Emulsion Layer | |
| Mixed silver chlorobromide emulsion (silver bromide: 75 mol %) | 0.16 g/m$^2$ as Ag |
| Gelatin | 1.80 g/m$^2$ |
| Magenta coupler | 0.34 g/m$^2$ |
| Color Image Stabilizer (f) | 0.20 g/m$^2$ |
| Solvent (g) | 0.68 ml/m$^2$ |
| Fourth Layer: Ultraviolet Absorbing Layer | |
| Gelatin | 1.60 g/m$^2$ |
| Ultraviolet Absorbent (h) | 0.62 g/m$^2$ |
| Color Mixing Preventing Agent (i) | 0.05 g/m$^2$ |
| Solvent (j) | 0.26 ml/m$^2$ |
| Fifth Layer: Red-Sensitive Emulsion Layer | |
| Mixed silver chlorobromide emulsion (silver bromide: 70 mol %) | 0.26 g/m$^2$ as Ag |
| Gelatin | 0.98 g/m$^2$ |
| Cyan Coupler (k) | 0.38 g/m$^2$ |
| Color Image Stabilizer (l) | 0.17 g/m$^2$ |
| Solvent (e) | 0.23 ml/m$^2$ |
| Sixth Layer: Ultraviolet Absorbing Layer | |
| Gelatin | 0.54 g/m$^2$ |
| Ultraviolet Absorbent (h) | 0.21 g/m$^2$ |
| Solvent (j) | 0.09 ml/m$^2$ |
| Seventh Layer: Protective Layer | |
| Gelatin | 1.33 g/m$^2$ |
| Acryl-modified copolymer of polyvinyl alcohol (modification degree of 17%) | 0.17 g/m$^2$ |

In addition, for each emulsion layer, the following spectral sensitizers were used.

For the Blue-sensitive Emulsion Layer:

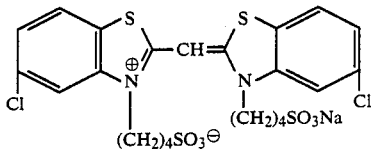

($7.0\times10^{-4}$ mol per mol of silver halide)

For the Green-sensitive emulsion layer:

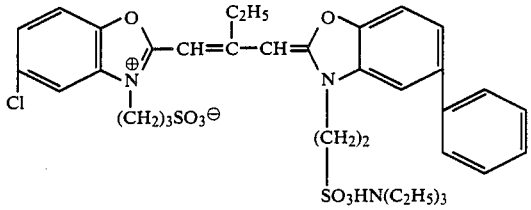

($4.0\times10^{-4}$ mol per mol of silver halide)

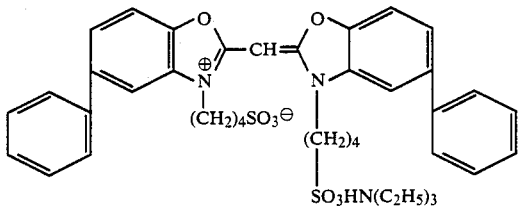

($7.0\times10^{-5}$ mol per mol of silver halide)

For the Red-sensitive emulsion layer:

-continued

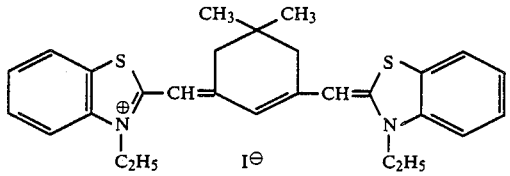

As irradiation preventing dyes for each emulsion layers, the following dyes were used.

For the Green-sensitive emulsion layer:

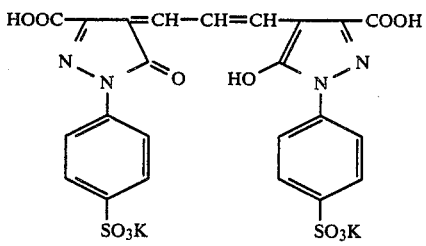

For the Red-sensitive emulsion layer:

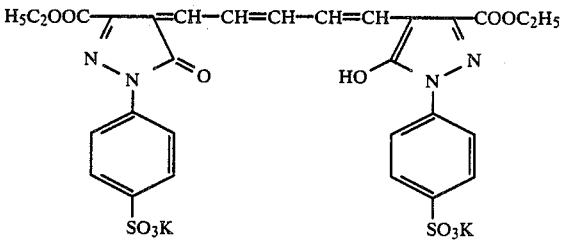

The compounds (couplers, etc.) used in the example were as follows:

Yellow coupler (a):

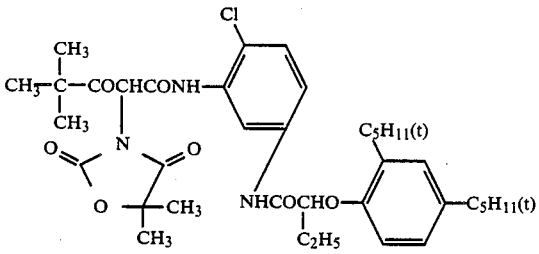

Color Image Stabilizer (b):

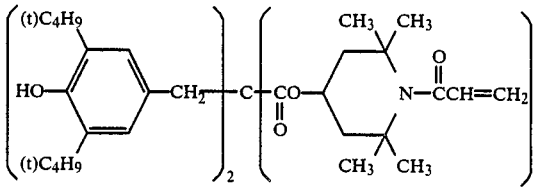

Solvent (c)

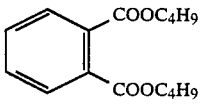

-continued

Color Mixing Preventing Agent (d)

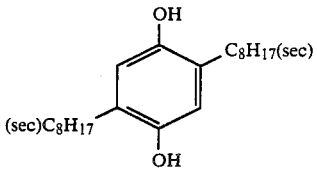

Solvent (e):

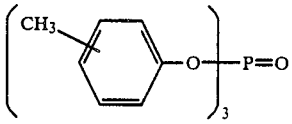

Color Image Stabilizer (f):

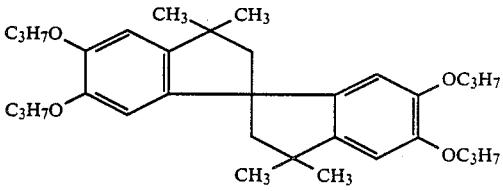

Solvent (g):

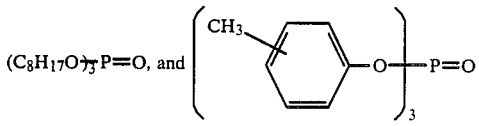

A mixture thereof at 2/1 (weight ratio)

Ultraviolet Absorbent (h):

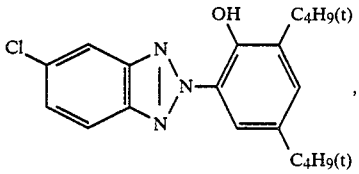

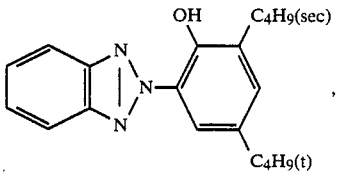

and

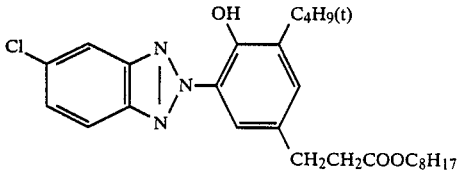

A mixture thereof at 1/5/3 (molar ratio)

Color Mixing Preventing Agent (i)

-continued

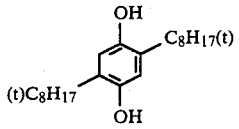

Solvent (j):

(iso $C_9H_{19}O)_3$ P=O

Cyan Coupler (k):

(k1)

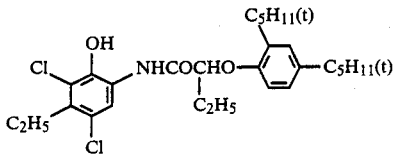

and (k2)

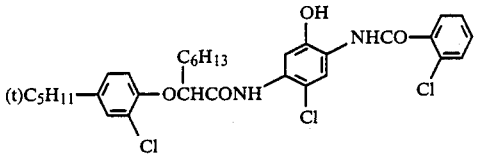

A mixture thereof at 1/1 (molar ratio)

Color Image Stabilizer (l):

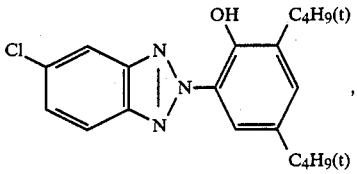

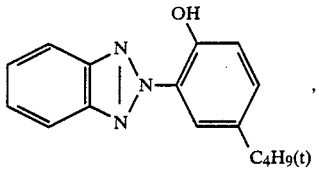

and

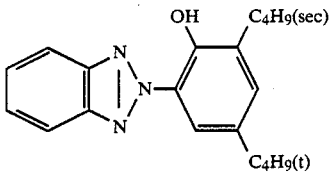

A mixture thereof at 1/3/3 (molar ratio)

Also, the magenta couplers used for the above samples were as follows.

For Sample (A):

-continued

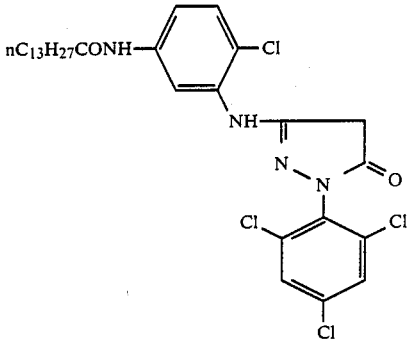

For Sample (B):

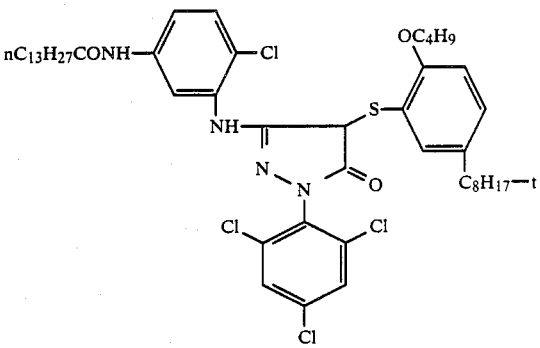

| For Sample (C): | For Sample (D): | For Sample (E): |
|---|---|---|
| Compound (M-42) | Compound (M-43) | Compound (M-57) |

Each of the samples thus prepared was subjected to stepwise exposure for sensitometry through each of a blue filter, green filter, and red filter, using a sensitometer (FWH type, manufactured by Fuji Photo Film Co., Ltd., color temperature of light source: 3,200° K.). In this case, the light exposure was performed to give an exposure amount of 250 CMS at an exposure time of 0.5 second.

Each of the samples thus exposed was processed by the following processing steps.

| Processing Step | Temperature (°C.) | Time |
|---|---|---|
| Color Development | 35 | 45 sec |
| Blixing (bleach-fixing) | 35 | 45 sec |
| Washing in Water | 35 | 1 min 30 sec |
| Drying | 80 | 1 min 00 sec |

The compositions of the processing liquids used in the above processing steps were as follows.

In this case, Composition A containing benzyl alcohol and Composition B containing no benzyl alcohol were used as the color developing solution.

| | Composition A | Composition B |
|---|---|---|
| Color Developing Solution: | | |
| Diethylenetriaminepentaacetic Acid | 2.0 g | 2.0 g |
| Benzyl Alcohol | 15 ml | — |
| Diethylene Glycol | 10 ml | — |
| Sodium Sulfite ($Na_2SO_3$) | Amount shown in Table 1 | |

-continued

| | Composition A | Composition B |
|---|---|---|
| Potassium Bromide (KBr) | 0.6 g | 0.6 g |
| Hydroxylamine Sulfate | Amount shown in Table 1 | |
| 4-Amino-3-methyl-N—ethyl-N—[β-(methanesulfonamido)-ethyl]-p-phenylenediamine Sulfate | 4.5 g | 4.5 g |
| Potassium Carbonate ($K_2CO_3$) | 40.0 g | 40.0 g |
| Water to make | 1000 ml | 1000 ml |
| pH | 10.25 | 10.25 |
| Blixing Solution: | | |
| Ammonium Thiosulfate (54 wt %) | 150 ml | |
| Sodium Sulfite ($Na_2SO_3$) | 15 g | |
| $NH_4$[Fe(III)(EDTA) | 55 g | |
| EDTA.2Na | 4 g | |
| Water to make | 1000 ml | |
| pH | 6.9 | |

The maximum density and minimum density of the magenta dye obtained were measured for each sample thus processed by means of a Macbeth densitometer and the results obtained are shown in Table 1 below.

color forming properties obtained were found to be still more excellent (as shown by the results of Samples (C), (D) and (E)).

EXAMPLE 2

The same multilayer color photographic paper as in Example 1 were subjected to a photographic processing including the following steps, which was the same as employed in Example 1 except that the rinsing step described below was carried out instead of the washing in water. Only when a sodium sulfite and a hydroxylamine were used in the concentrations specified by the present invention, reduced fog and sufficiently high color forming properties were achieved in a benzyl alcohol-free condition.

| Processing Step | Temperature | Time |
|---|---|---|
| Color Development | 35° C. | 45 sec. |
| Bleach-Fixing | 35° C. | 45 sec. |
| Rinsing 1 | 35° C. | 20 sec. |
| Rinsing 2 | 35° C. | 20 sec. |
| Rinsing 3 | 35° C. | 20 sec. |

TABLE 1

| Developing Solution No. | Benzyl Alcohol | $Na_2SO_3$ (g/liter) | Hydroxylamine Sulfate (g/liter) | Note | Sample (A) Density | | Sample (B) Density | | Sample (C) Density | | Sample (D) Density | | Sample (E) Density | |
|---|---|---|---|---|---|---|---|---|---|---|---|---|---|---|
| | | | | | Dmin | Dmax | Dmin | Dmax | Dmin | Dmax | Dmin | Dmax | Dmin | Dmax |
| 1 | present | 1.7 | 3.0 | Comparison | 0.21 | 2.15 | 0.23 | 2.20 | 0.23 | 2.15 | 0.23 | 2.10 | 0.23 | 2.15 |
| 2 | absent | 0.2 | 3.0 | Comparison | 0.18 | 1.88 | 0.18 | 1.52 | 0.20 | 1.48 | 0.20 | 1.60 | 0.19 | 1.77 |
| 3 | present | 2.0 | 0.5 | Comparison | 0.30 | 2.11 | 0.23 | 2.21 | 0.27 | 2.18 | 0.27 | 2.15 | 0.28 | 2.05 |
| 4 | absent | 2.0 | 0.5 | Comparison | 0.18 | 1.86 | 0.18 | 1.60 | 0.20 | 1.50 | 0.19 | 1.49 | 0.19 | 1.65 |
| 5 | present | 0.5 | 2.0 | Comparison | 0.25 | 2.13 | 0.31 | 2.20 | 0.31 | 2.16 | 0.30 | 2.11 | 0.31 | 2.16 |
| 6 | present | 0.5 | 1.0 | Comparison | 0.26 | 2.14 | 0.36 | 2.22 | 0.30 | 2.17 | 0.29 | 2.12 | 0.30 | 2.18 |
| 7 | present | 0.5 | 0.2 | Comparison | 0.35 | 2.15 | 0.40 | 2.24 | 0.32 | 2.18 | 0.31 | 2.12 | 0.32 | 2.18 |
| 8 | absent | 0.5 | 2.0 | Invention | 0.19 | 2.05 | 0.19 | 2.15 | 0.20 | 2.18 | 0.20 | 2.17 | 0.20 | 2.22 |
| 9 | absent | 1.0 | 1.0 | Invention | 0.20 | 2.06 | 0.20 | 2.15 | 0.21 | 2.20 | 0.20 | 2.19 | 0.21 | 2.25 |
| 10 | absent | 0.8 | 0.5 | Invention | 0.19 | 2.16 | 0.20 | 2.18 | 0.21 | 2.34 | 0.20 | 2.30 | 0.20 | 2.35 |
| 11 | absent | 0.8 | 0 | Invention | 0.21 | 2.20 | 0.21 | 2.19 | 0.22 | 2.35 | 0.21 | 2.36 | 0.21 | 2.40 |
| 12 | absent | 0.5 | 0.5 | Invention | 0.20 | 2.18 | 0.20 | 2.20 | 0.21 | 2.34 | 0.21 | 2.32 | 0.21 | 2.37 |
| 13 | absent | 0.2 | 0.5 | Invention | 0.20 | 2.18 | 0.20 | 2.21 | 0.21 | 2.35 | 0.20 | 2.33 | 0.20 | 2.42 |
| 14 | absent | 0.2 | 0.2 | Invention | 0.20 | 2.18 | 0.21 | 2.21 | 0.21 | 2.35 | 0.21 | 2.33 | 0.22 | 2.45 |
| 15 | absent | 0.2 | 0 | Invention | 0.21 | 2.20 | 0.21 | 2.25 | 0.22 | 2.40 | 0.22 | 2.38 | 0.22 | 2.47 |

As can be seen from the results of Comparative Examples 2 and 4, the color densities of the developed images were decreased when benzyl alcohol was not added. When benzyl alcohol was added, however, fog was generated, as seen in the results of Comparative Examples 3, 5, 6, and 7.

On the other hand, the addition of $Na_2SO_3$ and a hydroxylamine in reduced amounts specified in accordance with the present invention has proved to ensure reduced fog and sufficiently high color forming property in the absence of benzyl alcohol.

In addition, when the magenta couplers represented by formula (I) were employed in combination with the color developing solution of the present invention,

| Drying | 80° C. | 60 sec. |
|---|---|---|
| Composition of Rinsing Solution: | | |
| 1-Hydroxyethylidene-1,1'-diphosphonic Acid (60 wt %) | 1.6 ml | |
| Bismuth Chloride | 0.35 g | |
| Polyvinyl Pyrrolidone | 0.25 g | |
| Aqueous Ammonia (26 wt %) | 2.5 ml | |
| Trisodium Nitrilotriacetate | 1.0 g | |
| EDTA.4H | 0.5 g | |
| Sodium Sulfite | 1.0 g | |
| 5-Chloro-2-methyl-4-isothiazoline-3-one | 50 mg | |
| 2-Octyl-4-isothiazoline-3-one | 50 mg | |
| Brightening Agent (of 4,4'-diamino-stilbene type) | 1.0 g | |
| Water to make | 1000 ml | |

-continued

| | |
|---|---|
| Potassium Hydroxide to adjust | pH 7.5 |

(pH adjustment may be carried out using hydrochloric acid)

EXAMPLE 3

Each one liter portion of the same color developing solution Nos. 1, 3, 5, 6, 7, 8, 9, 10, 11, 12, 13, 14, and 15 as used in Example 1 was placed in a 1-liter polyethylene container, and allowed to stand for 1 month at 40° C. Thereafter, the extent of coloration and tar generation in each color developing solution were observed. In the color developing solution Nos. 1, 3, 5, 6, and 7 which contained benzyl alcohol, generation of tar was observed, notwithstanding the presence of large amounts of the preservatives. On the other hand, no generation of tar was observed in the benzyl alcohol-free color developing solution prepared in accordance with the present invention (Nos. 8, 9, 10, 11, 12, 13, 14, and 15), whereby the stability of the present color developing solution upon long-range storage has been found to be excellent.

EXAMPLE 4

A multilayer color photographic paper was prepared by coating photographic constituent layers shown below on a paper support laminated with polyethylene on both sides. The photographic paper was different from those prepared in Example 1, e.g., in magenta coupler and bromide contents in the silver chlorobromide emulsions. Coating compositions used for preparing the photographic papers were prepared in the following manner.

Coating Composition for First Layer 19.1 g of the yellow coupler (a) and 4.4 g of the image stabilizer (b) were dissolved in a mixture of 27.2 ml of ethyl acetate and 7.9 ml of the solvent (c). The resulting solution was emulsified and dispersed into 185 ml of a 10 wt% aqueous gelatin solution containing 8 ml of a 10 wt% sodium dodecylbenzenesulfonate. On the other hand, 90 g of a blue-sensitive emulsion was prepared by adding the blue-sensitive sensitizing dye illustrated below to a silver chlorobromide emulsion (having a bromide content of 1.0 mol% and containing 70 g of silver per kg of the emulsion) in an amount of $5.0\times10^{-4}$ mole per mole of silver chlorobromide. The emulsified dispersion and the silver chlorobromide emulsion were mixed and dissolved. Thereto, gelatin was further added so as to adjust a gelatin concentration to the value shown below. Thus, a coating composition for the first layer was obtained.

The coating compositions for the second to seventh layers were prepared in the same manner as in the first layer as described above. In each layer, sodium 2,4-dichloro-6-hydroxy-s-triazine sodium salt was employed as a gelatin hardener.

| Layer | Main Ingredients | Amount Used |
|---|---|---|
| 7th Layer (Protective layer) | Gelatin | 1.33 g/m$^2$ |
| | Acryl-modified copolymer of polyvinyl alcohol (modification degree of 17%) | 0.17 g/m$^2$ |
| 6th Layer (Ultraviolet absorbing layer) | Gelatin | 0.54 g/m$^2$ |
| | Ultraviolet absorbent (h) | 0.21 g/m$^2$ |
| | Solvent (j) | 0.09 ml/m$^2$ |
| 5th Layer (Red-sensitive emulsion layer) | Silver chlorobromide emulsion (Bromide content: 1.0 mol %) | 0.26 g/m$^2$ |
| | Gelatin | 0.98 g/m$^2$ |
| | Cyan coupler (k) | 0.38 g/m$^2$ |
| | Color image stabilizer (l) | 0.17 g/m$^2$ |
| | Solvent (e) | 0.23 ml/m$^2$ |
| 4th Layer (Ultraviolet absorbing layer) | Gelatin | 1.60 g/m$^2$ |
| | Ultraviolet absorbent (h) | 0.62 g/m$^2$ |
| | Color-mixing preventing agent (i) | 0.05 g/m$^2$ |
| | Solvent (j) | 0.26 ml/m$^2$ |
| 3rd Layer (Green-sensitive emulsion layer) | Silver chlorobromide emulsion (Bromide content: 0.5 mol %) | 0.16 g/m$^2$ |
| | Gelatin | 1.80 g/m$^2$ |
| | Magenta coupler (m) | 0.34 g/m$^2$ |
| | Color image stabilizer (f) | 0.20 g/m$^2$ |
| | Solvent (g) | 0.68 ml/m$^2$ |
| 2nd Layer (Color-mixing preventing layer) | Gelatin | 0.99 g/m$^2$ |
| | Color-mixing preventing agent (d) | 0.08 g/m$^2$ |
| 1st Layer (Blue-sensitive emulsion layer) | Silver chlorobromide emulsion (Bromide content: 1.0 mol %) | 0.30 g/m$^2$ |
| | Gelatin | 1.86 g/m$^2$ |
| | Yellow coupler (a) | 0.82 g/m$^2$ |
| | Color image stabilizer (b) | 0.19 g/m$^2$ |
| | Solvent (c) | 0.34 ml/m$^2$ |
| Support | Polyethylene-laminated paper (containing white pigment ($TiO_2$) and bluish pigment (ultramarine) in polyethylene laminate on the lst layer side) | |

Spectral sensitizers employed in the emulsions respectively are illustrated below.

Blue-sensitive Emulsion Layer

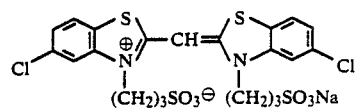

(Amount added: $5.0\times10^{-4}$ mol per mol of silver halide)

Green-sensitive Emulsion Layer

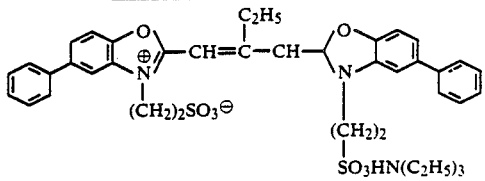

(Amount added: $4.0\times10^{-4}$ mol per mol of silver halide)

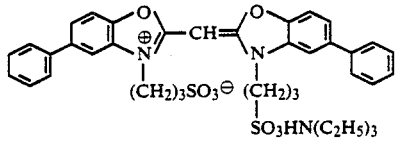

(Amount added: $7.0\times10^{-5}$ mol per mol of silver halide)

Red-sensitive Emulsion Layer

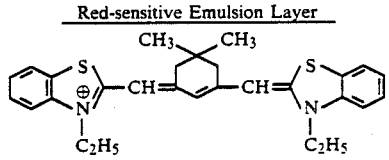

(Amount added: $0.9\times10^{-4}$ mol per mol of silver halide)

The following dyes were incorporated in their respective emulsion layers as an irradiation preventing dye.

Green-sensitive Emulsion Layer

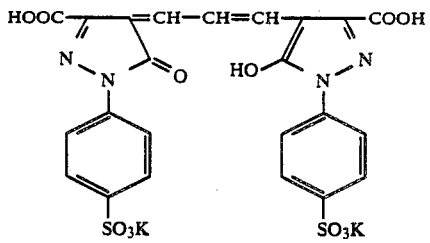

-continued

Red-sensitive Emulsion Layer

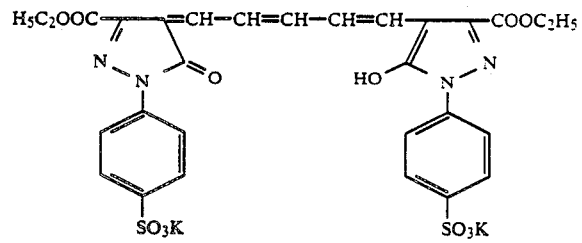

Structural formulae of the ingredients employed in this example, including couplers and others, are illustrated below.

(a) Yellow coupler

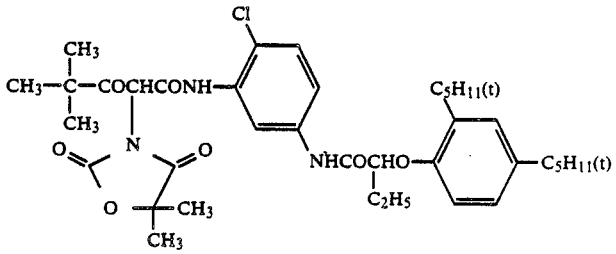

(b) Image Stabilizer

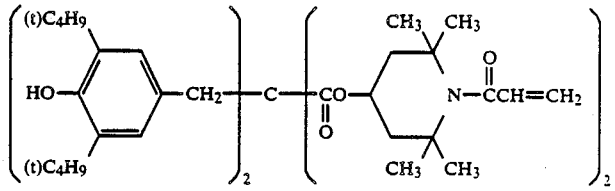

(c) Solvent

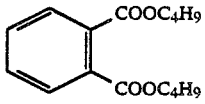

(d) Color-Mixing Preventing Agent

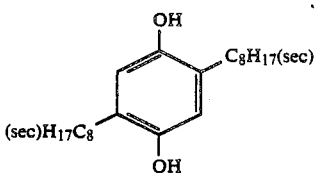

(e) Solvent

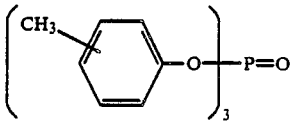

(f) Color Image Stabilizer

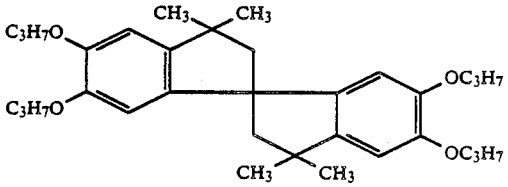

Solvent (g)

2/1 (by weight) Mixture of $(C_8H_{17}O)_3P{=}O$, and

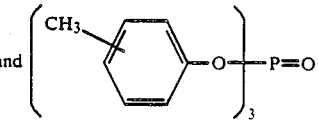

-continued
(h) Ultraviolet Absorbent
1/5/3 (by mole) Mixture of
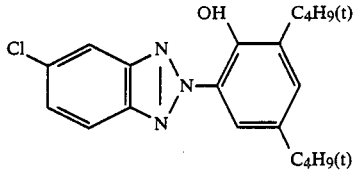
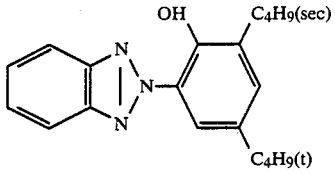
and
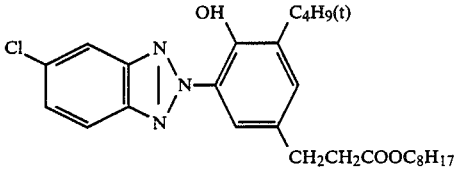
(i) Color Mixing Preventing Agent
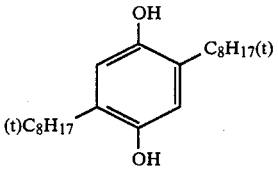
(j) Solvent
(iso $C_9H_{19}O)_3P{=}O$
(k) Cyan Coupler
1/1 (by mole) Mixture of
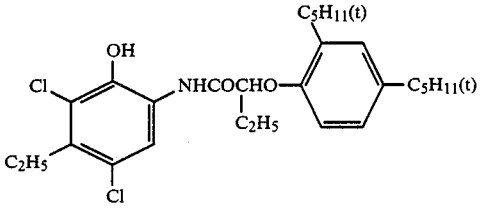
(k1)
and
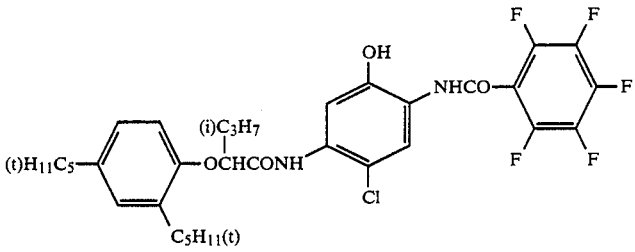
(k2)
(l) Color Image Stabilizer
1/3/3 (by mole) Mixture of
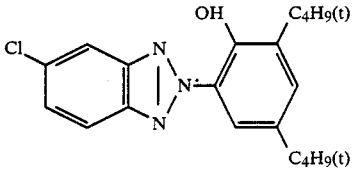

-continued

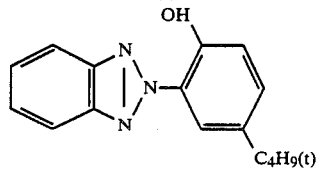

and

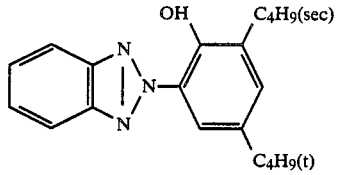

(m) Magenta Coupler

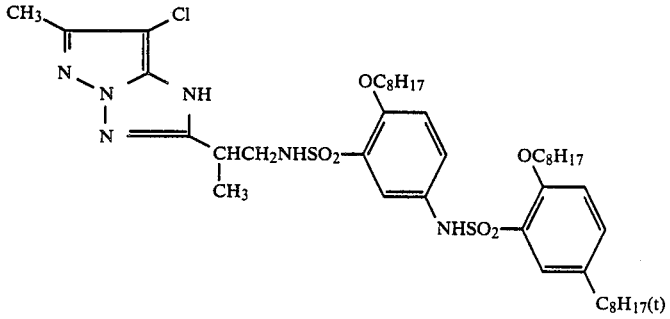

The thus obtained multilayer color photographic paper was subjected to the same processing steps as in Example 2. However, color developing solutions differing variously in contents of benzyl alcohol, sodium sulfite and the hydroxylamine salt, as shown in Table 2, where employed.

The processing solutions employed are as follows.

| | |
|---|---|
| Color Developing Solution: | |
| Triethanolamine | 10 g |
| N,N—Diethylhydroxylamine | 4 g |
| Brightening Agent (of 4,4'-diamino-stilbene type) | 3.0 g |
| Benzyl Alcohol | shown in Table 2 |
| Sodium sulfite | shown in Table 2 |
| Hydroxylamine Sulfate | shown in Table 2 |
| Potassium Carbonate | 30 g |
| EDTA.2Na.2$H_2O$ | 2 g |
| Potassium Bromide | 0.001 g |
| 4-Amino-3-methyl-N—ethyl-N—[β-(methanesulfonamido)ethyl]-p-phenylenediamine Sulfate | 5.0 g |
| Sodium Chloride | 2.0 g |
| Water to make | 1000 ml |
| pH adjusted to | 10.20 |
| Bleach-Fixing Bath: | |

-continued

| | |
|---|---|
| EDTA.Fe(III)$NH_4$.2$H_2O$ | 60 g |
| EDTA.2Na.2$H_2O$ | 4 g |
| Ammonium Thiosulfate (70 wt %) | 120 ml |
| Sodium Sulfite | 16 g |
| Aldehyde-Sulfite Adduct | 10 g |
| Glacial Acetic Acid | 7 g |
| Water to make | 1000 ml |
| pH adjusted to | 5.5 |
| Rinsing Solution: | |
| EDTA.2Na.2$_2$O | 0.4 g |
| Water to make | 1000 ml |
| pH adjusted to | 7.0 |

Data on Dmin and Dmax of colors B (Blue), G (Green) and R (Red) each are shown in Table 2.

TABLE 2

| Developing Solution No. | Benzyl Alcohol (ml/liter) | $Na_2SO_3$ (g/liter) | Hydroxylamine Sulfate (g/liter) | B Dmin | B Dmax | G Dmin | G Dmax | R Dmin | R Dmax | Note |
|---|---|---|---|---|---|---|---|---|---|---|
| 16 | 8 | 1.7 | 3.0 | 0.30 | 2.01 | 0.25 | 2.20 | 0.21 | 2.31 | Comparison |
| 17 | 0 | 1.7 | 3.0 | 0.18 | 1.02 | 0.20 | 1.21 | 0.20 | 1.50 | " |
| 18 | 0 | 0 | 3.0 | 0.18 | 1.45 | 0.20 | 1.43 | 0.20 | 1.61 | " |
| 19 | 0 | 1.7 | 0 | 0.18 | 1.15 | 0.20 | 1.45 | 0.20 | 1.68 | " |
| 20 | 0 | 0 | 2.0 | 0.18 | 1.60 | 0.20 | 1.60 | 0.20 | 1.70 | " |
| 21 | 0 | 0.5 | 0 | 0.18 | 1.93 | 0.19 | 2.15 | 0.20 | 2.21 | Invention |
| 22 | 0 | 0 | 0.5 | 0.18 | 1.97 | 0.19 | 2.18 | 0.20 | 2.19 | " |
| 23 | 0 | 0 | 0 | 0.18 | 2.00 | 0.19 | 2.21 | 0.20 | 2.30 | " |

According to the present invention (Nos. 21 to 23), reduced fog and sufficiently high color densities were obtained. In contrast to such results, fog was caused by the presence of benzyl alcohol (as seen in No. 16) and Dmax was lowered by the presence of hydroxylamine sulfate and sodium sulfite in concentrations higher than those specified by the present invention (as seen in Nos. 17 to 20).

Without using substantially with benzyl alcohol in accordance with the embodiments of the present invention, the load of environmental pollution can be reduced, the work for preparing a color developing solution can be saved, and a decrease in color density due to a cyan dye existing in the form of leuco body can be prevented. In addition, generation of tar in the color developing solution upon storage over a long period of time was prevented, and excellent storage stability was imparted to the color developing solution.

Further, a large quantity of color paper can be processed rapidly, whereby productivity can be increased dramatically. Furthermore, in accordance with the present invention, there can be provided color prints of excellent quality, that is, showing a slight decrease in color density of the developed image and a reduced fog (stain), even when photographic paper is subjected to short-time processing using a color developing solution substantially free from benzyl alcohol.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material, which comprises subjecting an imagewise exposed silver halide color photographic material having at least one silver halide emulsion layer on a reflective support to color development for a period not exceeding 2 minutes and 30 seconds using a color-developing solution containing 0.5 ml/liter or less benzyl alcohol, a sulfite in a concentration of $8\times10^{-3}$ mol/liter or less, and a hydroxylamine in a concentration of $1.5\times10^{-2}$ mol/liter or less.

2. A method for processing a silver halide color photographic material as in claim 1, wherein the silver halide color photographic material contains a magenta coupler represented by formula (I)

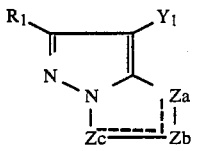

(I)

wherein $R_1$ represents a hydrogen atom or a substituent group; $Y_1$ represents a group capable of being released upon a coupling reaction with an oxidation product of an aromatic primary amine-developing agent; and Za, Zb, and Zc each represents an unsubstituted methine group, a substituted methine group, =N—, or —NH—, provided that either of the Za—Zb bond or the Zb—Zc bond is a double bond, and the other is a single bond.

3. A method for processing a silver halide color photographic material as in claim 1, wherein the color development time is from 30 seconds to 2 minutes.

4. A method for processing a silver halide color photographic material as in claim 2, wherein the color development time is from 30 seconds to 2 minutes.

5. A method for processing a silver halide color photographic material as in claim 1, wherein the color developing solution contains no benzyl alcohol at all.

6. A method for processing a silver halide color photographic material as in claim 2, wherein the color developing solution contains no benzyl alcohol at all.

7. A method for processing a silver halide color photographic material as in claim 1, wherein the sulfite concentration ranges from $1.6\times10^{-3}$ to $6.5\times10^{-3}$ mol/liter.

8. A method for processing a silver halide color photographic material as in claim 2, wherein the sulfite concentration ranges from $1.6\times10^{-3}$ to $6.5\times10^{-3}$ mol/liter.

9. A method for processing a silver halide color photographic material as in claim 1, wherein the concentration of hydroxylamine in the color developing solution is not more than $3.8\times10^{-3}$ mol/liter.

10. A method for processing a silver halide color photographic material as in claim 2, wherein the concentration of hydroxylamine in the color developing solution is not more than $3.8\times10^{-3}$ mol/liter.

11. A method for processing a silver halide color photographic material as in claim 1, wherein the color developing solution is free from hydroxylamine.

12. A method for processing a silver halide color photographic material as in claim 2, wherein the color developing solution is free from hydroxylamine.

13. A method for processing a silver halide color photographic material as in claim 2, wherein said magenta coupler represented by formula (I) is selected from 1H-imidazo[1,2-b]pyrazoles, 1H-pyrazolo[1,5-b]pyrazoles, 1H-pyrazolo[5,1-c][1,2,4]triazoles, 1H-pyrazolo[1,5-d]tetrazoles, 1H-pyrazolo[1,5-a]benzimidazoles, and 1H-pyrazolo[1,5-b][1,2,4]triazoles.

14. A method for processing a silver halide color photographic material as in claim 2, wherein said magenta coupler is a compound represented by formula (II), (III), (IV), (V), (VI) or (VII)

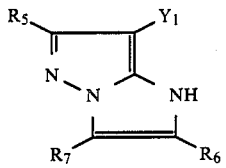

[II]

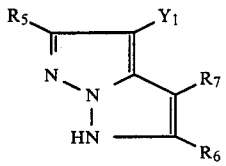

[III]

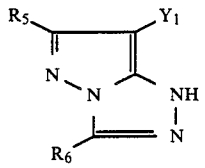

[IV]

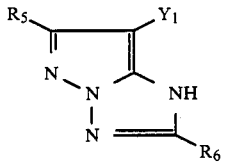

[V]

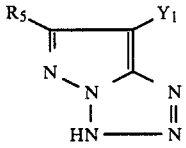

[VI]

-continued

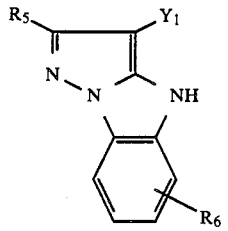

[VII]

wherein $R_5$, $R_6$ and $R_7$ (which may be the same or different) each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and $Y_1$ represents a hydrogen atom, a halogen atom, a carboxyl group or a coupling releasable group capable of being released upon coupling by being bonded with the carbon atom located at the coupling position through an oxygen atom, a nitrogen atom or a sulfur atom, or alternatively, $R_5$, $R_6$, $R_7$ or $Y_1$ represents a divalent group forming a bis coupler; and wherein the couplers represented by formulae (II), (III), (V), (VI), or (VII) may be in the form of a polymeric coupler in which the coupler comprises a vinyl monomer and $R_5$, $R_6$ or $R_7$ represents a chemical bond or a connecting group, through which the couplers represented by formulae (II), (III), (IV), (V), (VI), or (VII) and the vinyl group are connected together.

15. A method for processing a silver halide color photographic material as in claim 2, wherein said magenta coupler is a compound represented by formula (IV) or (V)

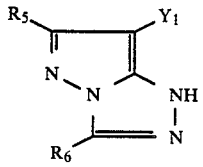

(IV)

-continued

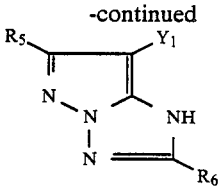

(V)

wherein $R_5$ and $R_6$ each represents a hydrogen atom, a halogen atom, an alkyl group, an aryl group, a heterocyclic group, a cyano group, an alkoxy group, an aryloxy group, a heterocyclicloxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclicthio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; and $Y_1$ represents a hydrogen atom, a halogen atom, a carboxyl group, or a coupling releasable group capable of being released upon coupling by being bonded with the carbon atom located at the coupling position through an oxygen atom, a nitrogen atom or a sulfur atom.

16. A method for processing a silver halide color photographic material as in claim 15, wherein the magenta coupler is represented by formula (IV) or (V) wherein at least one of $R_5$ and $R_6$ is a branched substituted or unsubstituted alkyl group which is an alkyl group or a substituted alkyl group which is connected to a pyrazoloazole skeleton through a secondary or tertiary carbon atom.

17. A method for processing a silver halide color photographic material as in claim 16, wherein the secondary or tertiary carbon atom has at least two groups selected from an alkyl group or a substituted alkyl group.

18. A method for processing a silver halide color photographic material as in claim 17, wherein the secondary or tertiary carbon atom has at least one of a sulfonamido alkyl group, a sulfonamidoaryl alkyl group, or a sulfonylalkyl group.

19. A method for processing a silver halide color photographic material as in claim 1, wherein the color developing solution contains an aromatic primary amine color developing agent.

20. A method for processing a silver halide color photographic material as in claim 19, wherein the aromatic primary amine color developing agent is N-ethyl-N-(β-methanesulfonamidoethyl)-3-methyl-4-aminoaniline.

* * * * *